US006682367B2

(12) United States Patent
Suzuki

(10) Patent No.: US 6,682,367 B2
(45) Date of Patent: Jan. 27, 2004

(54) HOLDER-EQUIPPED CONNECTOR

(75) Inventor: Kenji Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/187,842

(22) Filed: Jul. 3, 2002

(65) Prior Publication Data

US 2003/0008557 A1 Jan. 9, 2003

(30) Foreign Application Priority Data

Jul. 4, 2001 (JP) ..... 2001-203399

(51) Int. Cl.[7] ..... H01R 13/40
(52) U.S. Cl. ..... 439/595
(58) Field of Search ..... 439/595, 587, 439/752, 598, 686, 695, 701

(56) References Cited

U.S. PATENT DOCUMENTS 5,877,622 A * 3/1999 Aoyama ..... 324/158.1
5,879,192 A * 3/1999 Machida ..... 439/598
6,094,813 A * 8/2000 Akeda et al. ..... 29/877

* cited by examiner

*Primary Examiner*—Jean F. Duverne
(74) *Attorney, Agent, or Firm*—Armstrong, Kratz, Quintos, Hanson & Brooks, LLP

(57) ABSTRACT

A holder-equipped connector with a downsized connector housing is provided, which includes: a terminal; a connector housing provided with a lance to primarily lock the terminal; and a holder to hold the terminal, wherein a relief portion to secure a bending amount of the lance, being bent when the terminal is attached to the connector housing, is provided on a basewall of the connector housing. The relief portion is a groove provided from a front opening of the connector housing to a vicinity of a root of the lance linearly in a terminal inserting direction.

12 Claims, 26 Drawing Sheets

HOLDER-EQUIPPED CONNECTOR

BACKGROUND OF THE INVENTION

1. Field of the Invention

The present invention relates to a holder-equipped connector of a vehicle use, wherein a connector housing thereof is downsized.

2. Description of the Related Art

A connector housing 110 shown FIG. 33 and FIG. 34 and a connector housing 110' shown in FIG. 35 each are surrounded with respective peripheral walls 112,112' formed with ceiling walls 112*a*, bottom walls 112*b* and sidewalls 112*c*,112*c'*. Terminal accommodating chambers 111*a,* rear openings 111*b* and front openings 112*d*,112*d'* are formed on the respective connector housings 110,110'. And, the terminal accommodating chamber 111*a* is surrounded with a partition wall 111*c* continuing from a locking lance 111*g,* a front horizontal partition wall 111*c',* a vertical partition wall 111*d* and a rear horizontal partition wall 111*e.*

The lance 111*g* engages a male terminal 140 in the terminal accommodating chamber 111*a* of the connector housing 110,110' and is integrally formed with a partition wall 111*c* (111*c'*,111*e*) of the connector housing 110,110'.

The male terminal 140 has an electrical contact portion 144, a wire connecting portion 141. The electrical contact portion 144 is of a tabular tab type (male tab 144). A cable 150 (wire) is connected to the wire connecting portion 141.

The male terminal 140 positioned at the lower side in the connector housing 110 shown in FIG. 33 is on the way of insertion. The male terminal 140 is inserted in a terminal accommodating chamber 111*a* from a rear opening 111*b* of the connector housing 110. As shown in FIG. 34, the male terminal 140 is engaged with a lance 111*g* provided in the terminal accommodating chamber 111*a* of the connector housing 110.

As shown in FIG. 33, the male terminal 140 gets over the locking lance 111*g* pressed by the male terminal 140 and elastically deformed, and subsequently as shown in FIG. 34 the locking lance 111*g* resiles.

However, the above prior art connector C10 is not a compact nor downsized one, even though, for example, the thickness of a peripheral wail 112, such as a bottom wall 112*b*, forming the connector housing 110 is reduced, the bending amount of the locking lance 111*g* is reduced, and the thickness of the locking lance 111*g* is reduced.

In downsizing the connector C10 shown in FIG. 33 and FIG. 34, it is effective to reduce a distance Lh.

However, if the above dimension Lh is reduced to Lh' (FIG. 35) without changing the positional relation between the terminal 140 and the locking lance 111*g* or the form thereof, the bending amount of the locking lance 111*g* provided on the connector housing 110 is not secured. Therefore, as shown in FIG. 35, the terminal 140 can not be inserted into the lower terminal accommodating chamber 111*a* of the connector housing 110'.

A difference between a dimension Lj shown in FIG. 33 and a dimension Li shown in FIG. 34 is the bending amount of the locking lance 111*g*. As understood from FIG. 33, a dimension Lk is required when the terminal 140 is inserted into the lower terminal insertion chamber 111*a* of the connector housing 110.

SUMMARY OF THE INVENTION

In view of the foregoing, an object of the present invention is to provide a holder-equipped connector, for use in a motor vehicle, wherein a connector housing thereof is downsized without making a large design change while keeping a mechanical strength of the connector housing.

In order to achieve the above object, as a first aspect of the present invention, a holder-equipped connector comprises: a terminal; a connector housing provided with a lance to primarily lock the terminal; and a holder to hold the terminal, wherein a relief portion to secure a bending amount of the lance, being bent when the terminal is attached to the connector housing, is provided on a basewall of the connector housing.

According to the above structure, because the relief portion securing the bending amount of the lance is provided on the basewall of the connector housing, the lance pushed and bent by the terminal does not interfere with the basewall of the connector housing with all the downsized connector housing when the terminal is inserted into the connector housing.

As a second aspect of the present invention, based on the first aspect, the relief portion is a groove provided from a front opening of the connector housing to a vicinity of a root of the lance linearly in a terminal inserting direction.

According to the above structure, because the groove securing the bending amount of the lance is provided in the terminal inserting direction, the mechanical strength required for the connector housing is secured though the connector housing is downsized.

As a third aspect of the present invention, based on the first aspect, a pair of tapered planes are provided on a surface, facing the basewall, of the lance, and a pair of slanting planes are provided on the relief portion formed on the basewall of the connector housing correspondingly to the pair of tapered plane.

According to the above structure, when the lance is bent by the terminal, the lance can smoothly enter the relief portion provided on the basewall of the connector housing.

As a fourth aspect of the present invention, based on the first aspect, the relief portion is a groove provided from one sidewall to the other sidewall of the connector housing in a direction orthogonal to a terminal inserting direction.

According to the above structure, because the groove securing the bending amount of the lance can be small, the groove does not almost affect the mechanical strength of the connector housing.

As a fifth aspect of the present invention, based on any one of the first to fourth aspects, the holder-equipped connector further comprises: a spacer to secondarily lock the terminal to the connector housing, wherein the spacer provisionally engaging the connector housing finally engages the connector housing when the spacer is further deeply inserted from a side of the basewall of the connector housing, and the terminal is double locked by the lance formed integrally with a terminal accommodating chamber of the connector housing and by a slanting partition wall formed on the spacer.

According to the above structure, because the terminal is securely double-locked by the connector housing and the spacer, the terminal can be prevented from coming off even if the cable (wire) connected to the terminal is strongly pulled.

As a sixth aspect of the present invention, based on any one of the first to fourth aspects, the holder-equipped connector further comprises: a spacer to secondarily lock the terminal to the connector housing, wherein the spacer finally engages the connector housing when the spacer is inserted from a side of the basewall of the connector housing, and the terminal is double locked by the lance formed integrally with a terminal accommodating chamber of the connector housing and by a partition wall formed on the spacer.

According to the above structure, because the terminal is securely double-locked by the connector housing and the spacer, the terminal can be prevented from coming off even if the cable (wire) connected to the terminal is strongly pulled.

The above and other objects and features of the present invention will become more apparent from the following description taken in conjunction with the accompanying drawings.

DESCRIPTION OF THE PREFERRED EMBODIMENT(S)

Embodiment(s) of the present invention will now be described in further detail with reference to the accompanying drawings.

Figure 1:
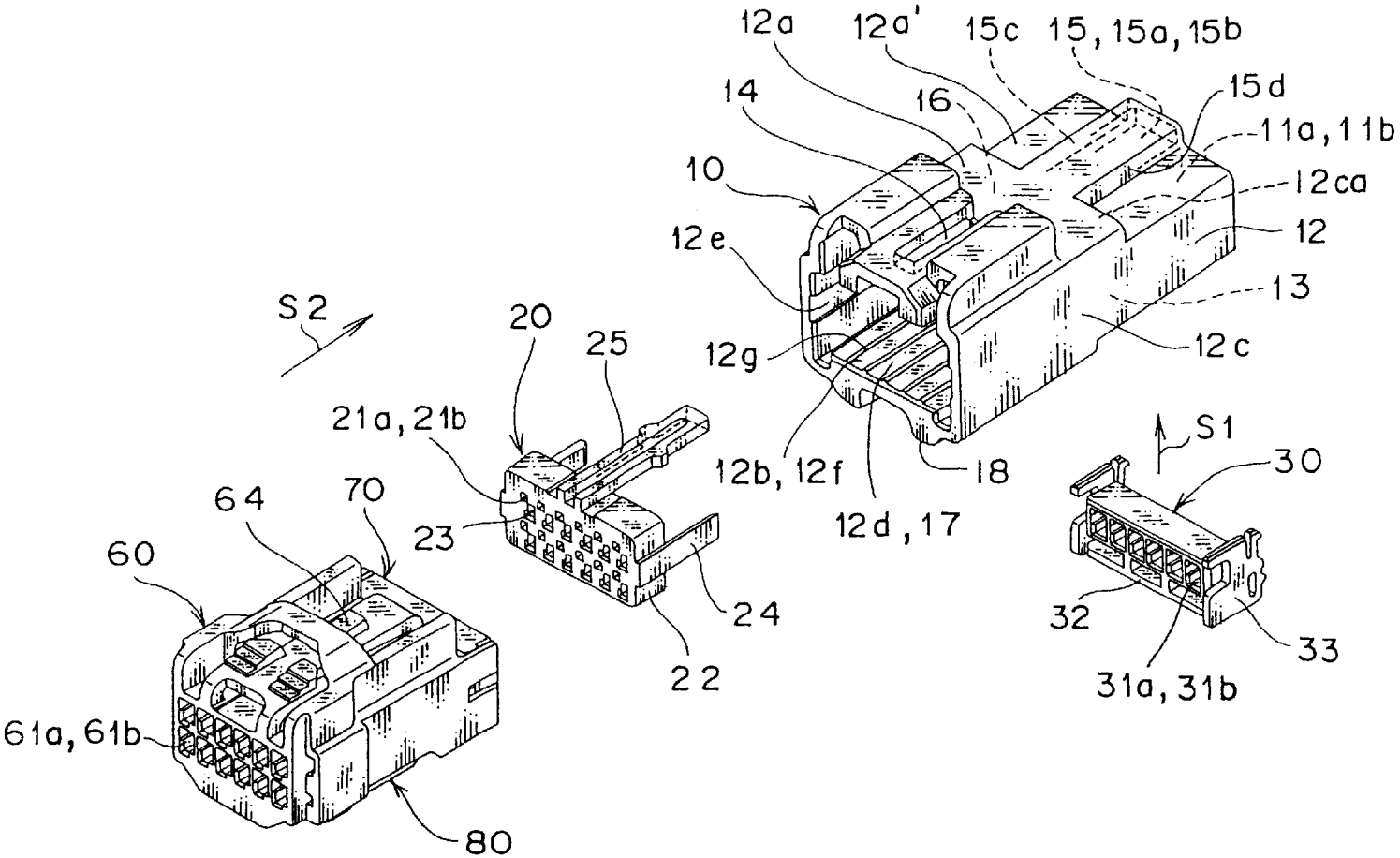
FIG. 1 is an exploded perspective view showing an embodiment of the inventive holder-equipped connector.
Figure 19:
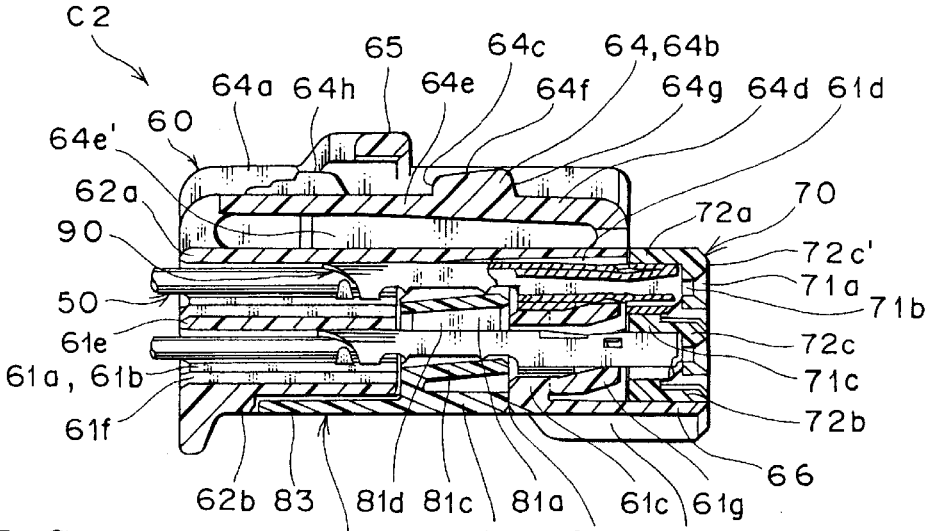
FIG. 19 is a longitudinal sectional view showing the other connector.
Figure 20:
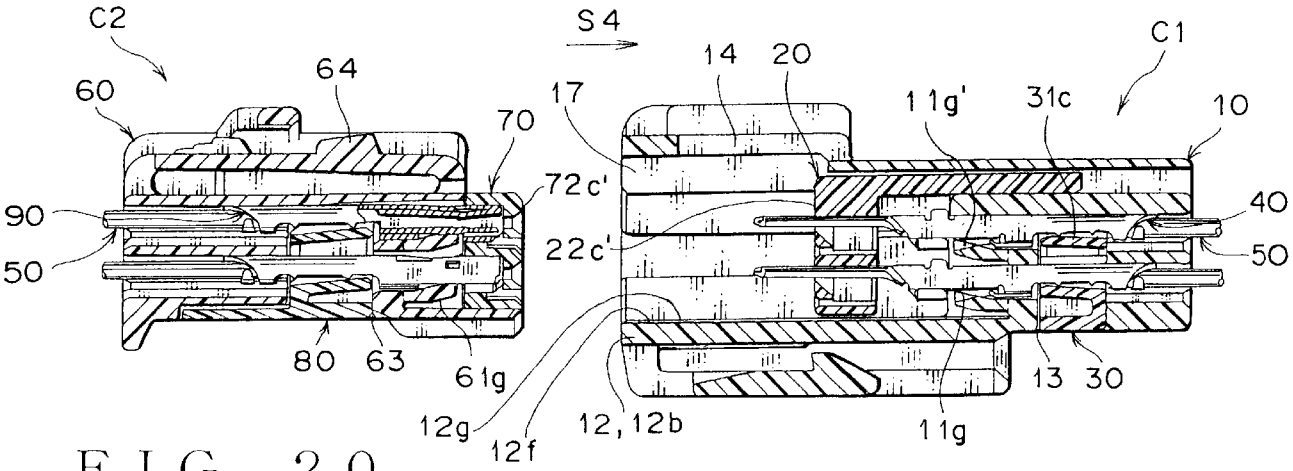
FIG. 20 is a longitudinal sectional view showing a state that the connectors are going to be coupled with each other.
Figure 21:
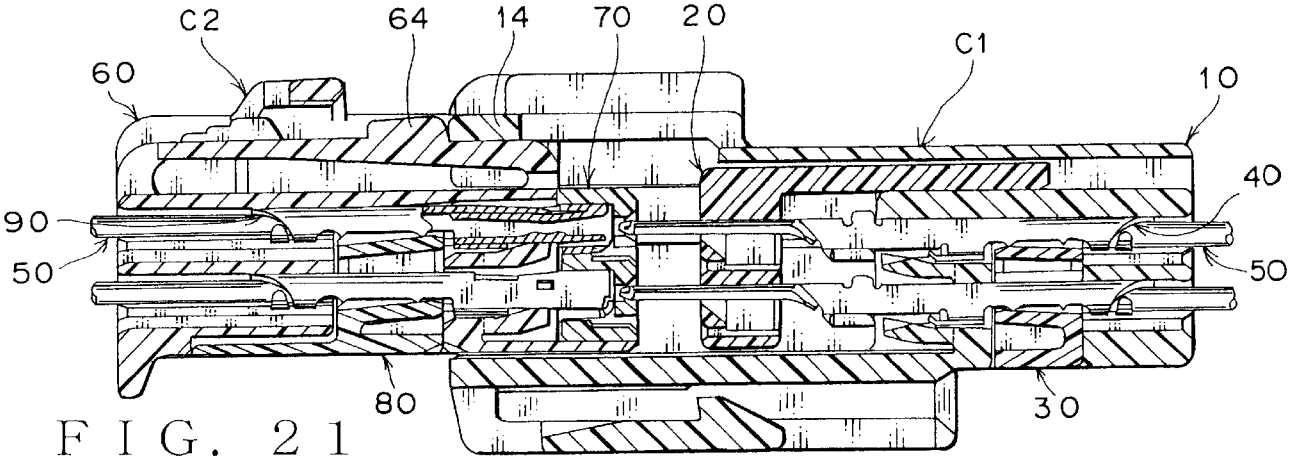
FIG. 21 is a longitudinal sectional view showing a state that the coupling of the connectors is started.

The direction of the holder-equipped connector is described on the basis of FIGS. 1,16,19, and 20. Referring to FIGS. 1,20, a side of an engaging lock portion 14 of the connector housing 10 or a side of an engaging lock portion 64 of a connector housing 60 is the upper side, and a side of a spacer insertion opening 13 of the connector housing 10 or a side of spacer insertion opening 63 of the connector housing 60 is the bottom side.

Figure 16:
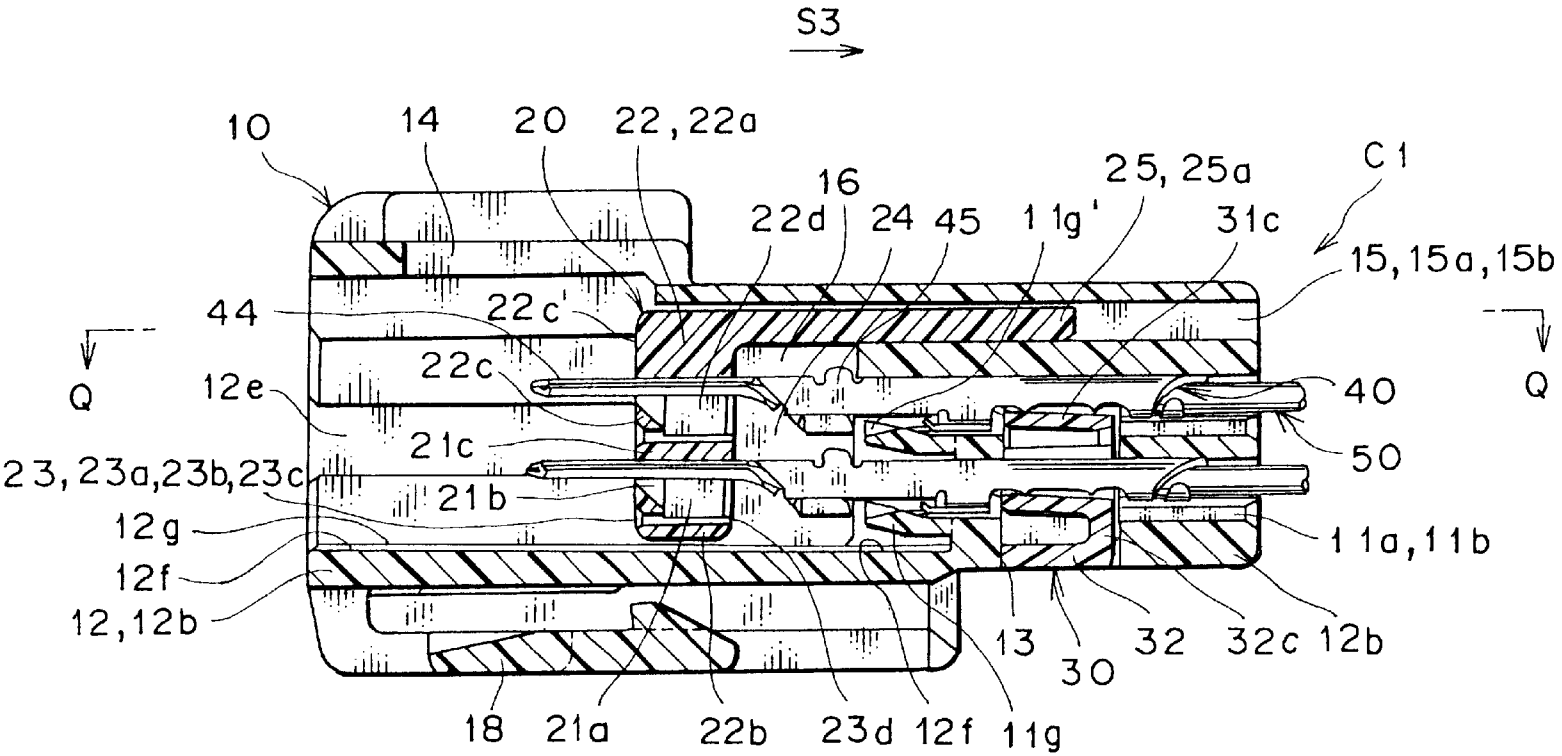
FIG. 16 is a longitudinal sectional view showing a state that the male terminals are secondarily-locked by the spacer in the connector housing.

A side of a coupling face of the connector C1 shown in FIG. 16 and FIG. 20 or a side of coupling face of the connector C2 shown in FIG. 19 and FIG. 20 is the front side.

As shown in FIG. 1, FIGS. 20–24, the connector C1 has the connector housing 10, a holder 20 being a front holder 20, a spacer 30, and a male terminal 40, and the connector C2 (a mating connector) has a connector housing 60, a front holder 70, a spacer 80, and a female terminal 90. Both the connectors C1,C2 are electrically connected.

Figure 27:
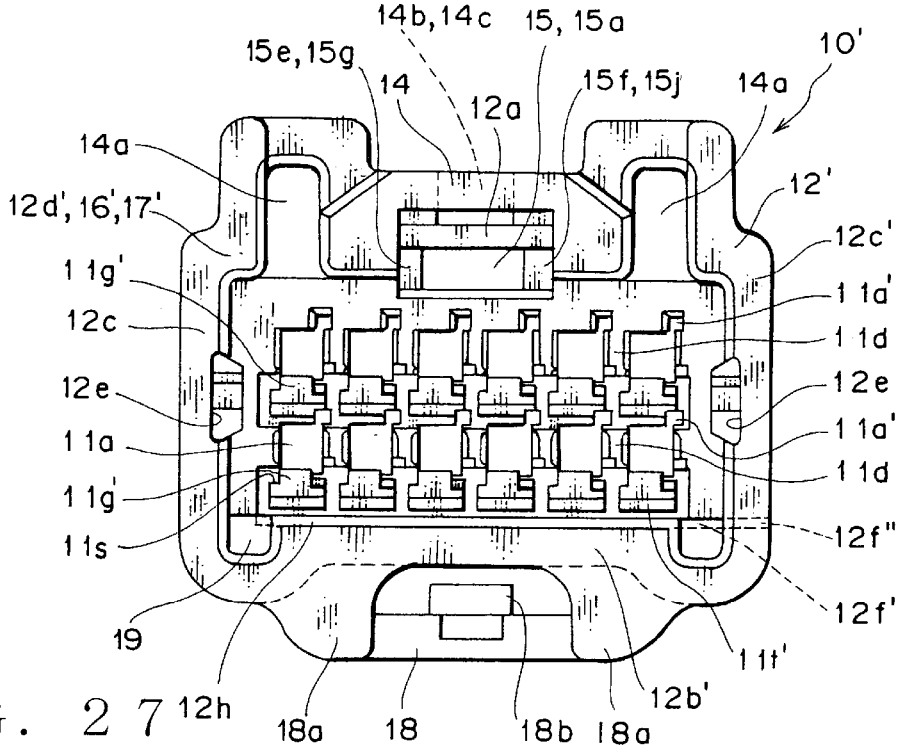
FIG. 27 is a front view showing the connector housing of FIG. 25.
Figure 25:
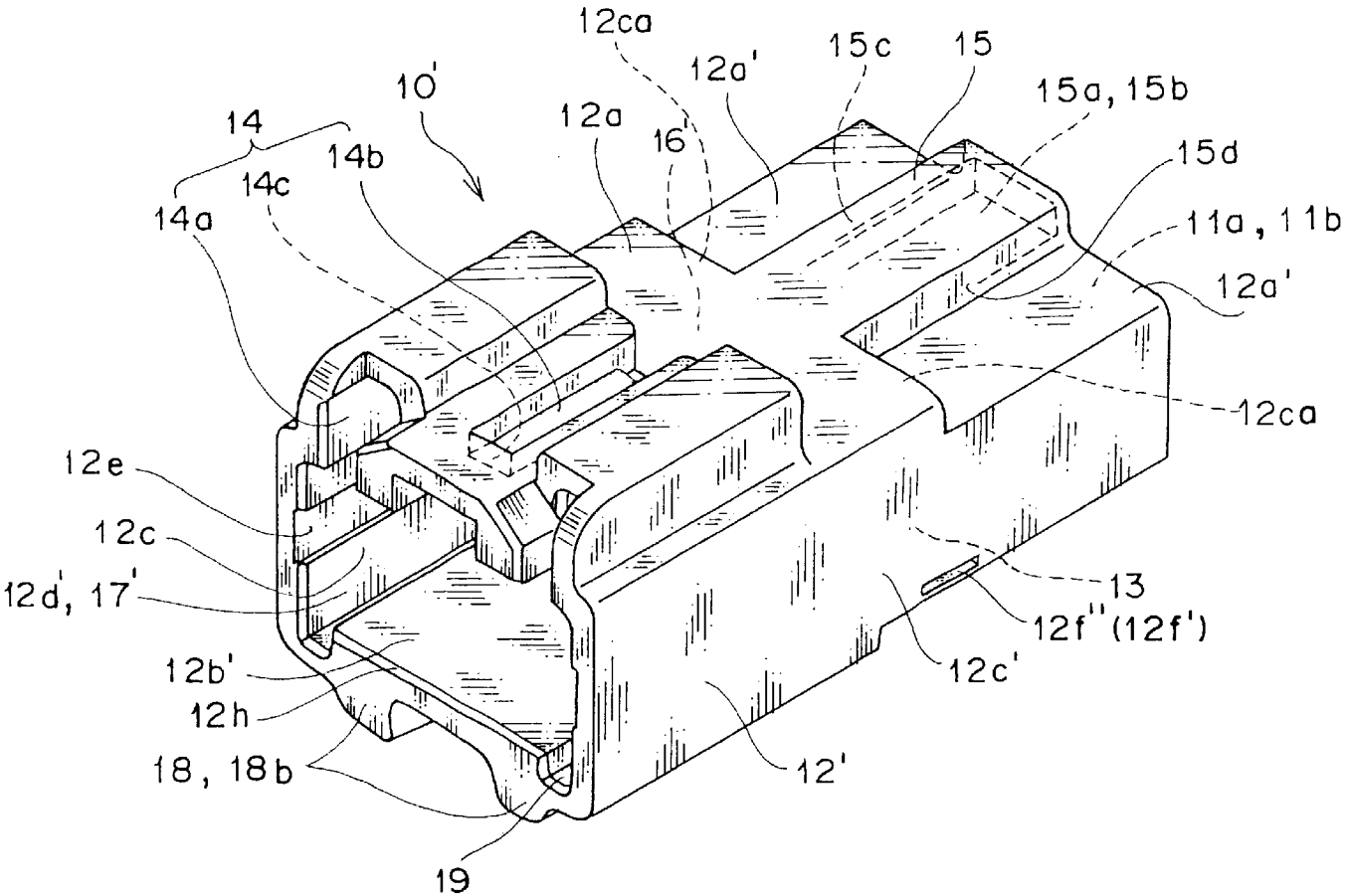
FIG. 25 is a perspective view showing another embodiment of the connector housing.
Figure 26:
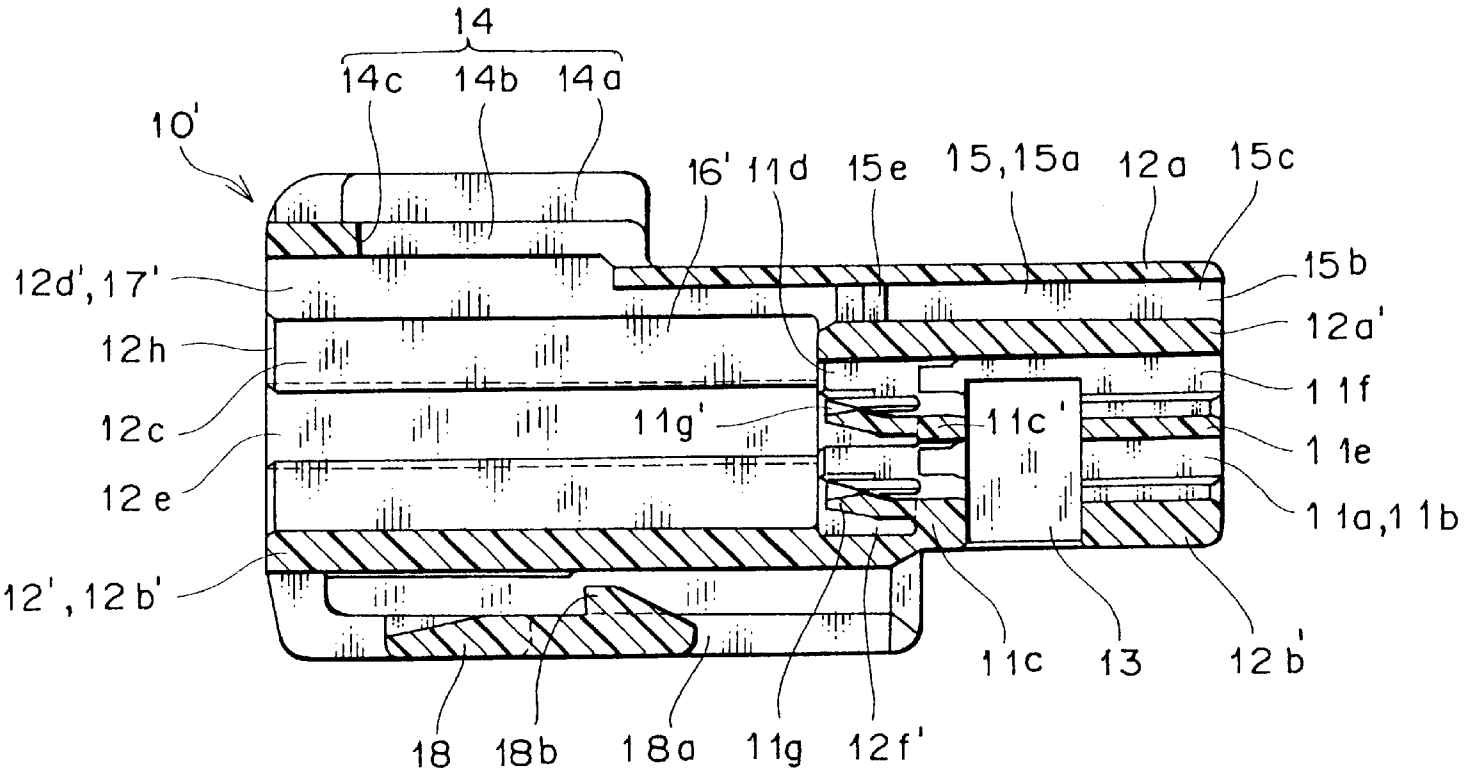
FIG. 26 is a longitudinal sectional view showing the connector housing of FIG. 25.
Figure 28:
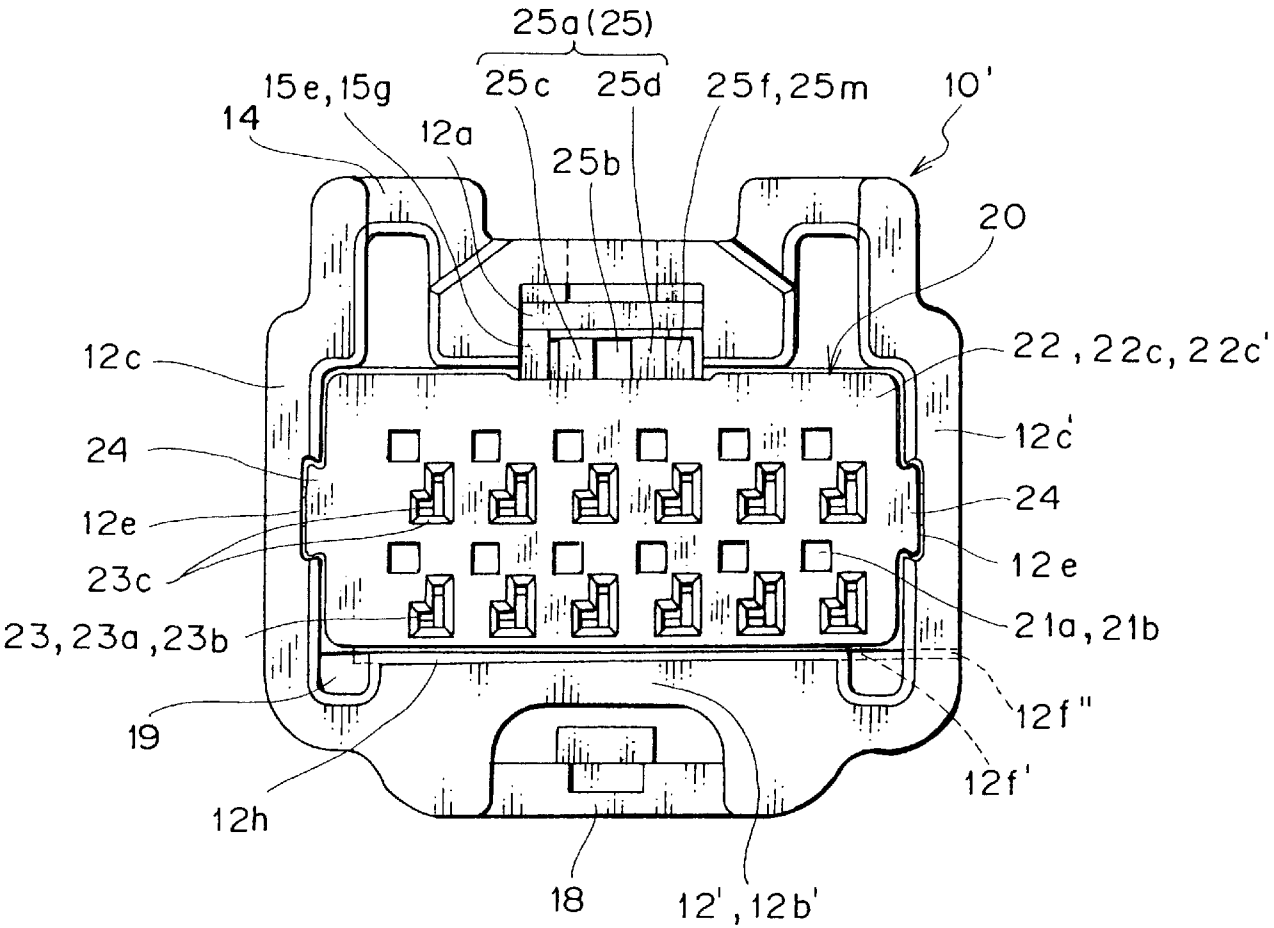
FIG. 28 is a front view showing the connector, of FIG. 25, with the front holder.
Figure 31:
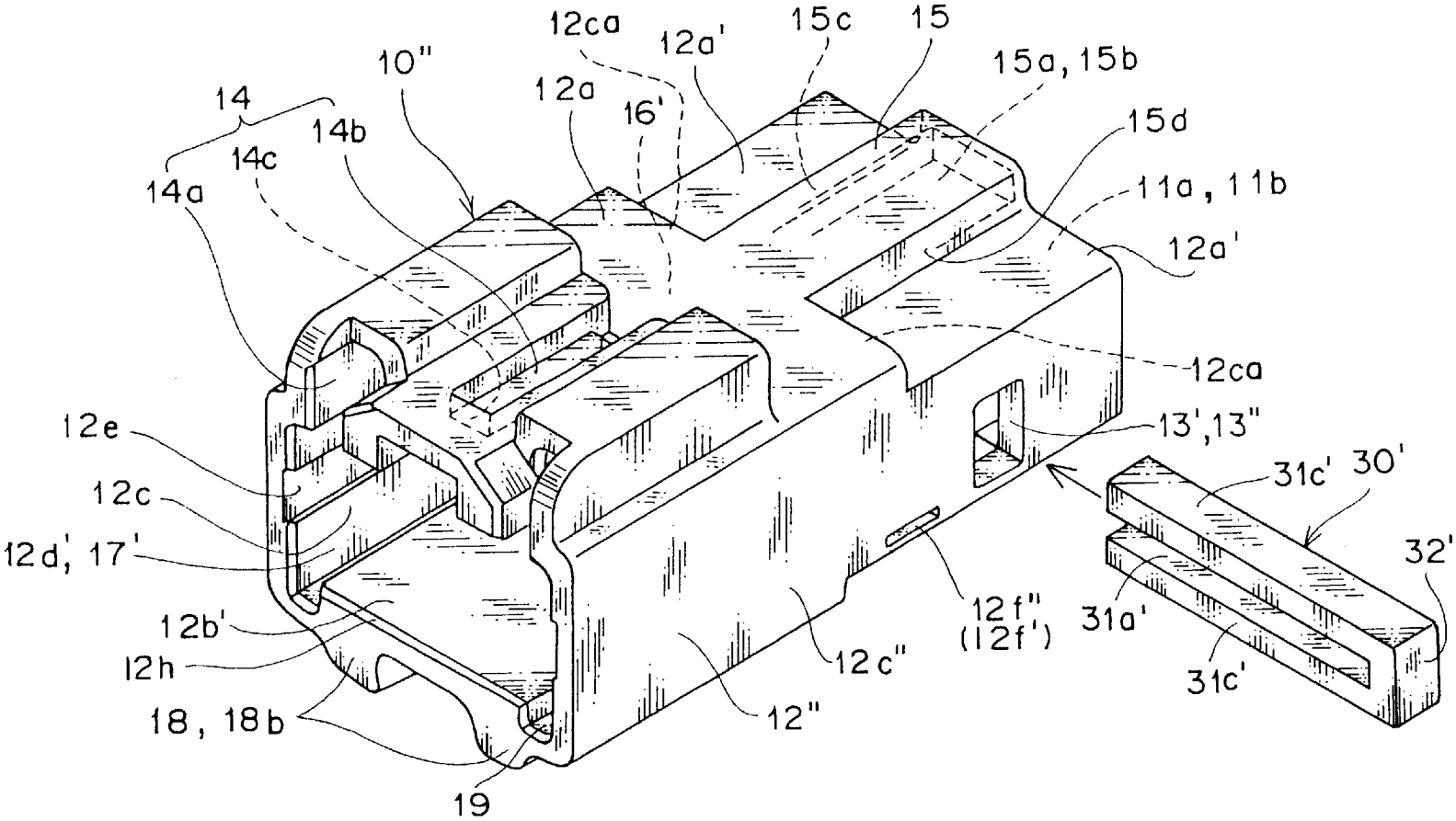
FIG. 31 it is an exploded perspective view showing still another embodiment of the connector housing and the spacer.

The connector housing 10 is shown in FIG. 1–FIG. 5, a connector housing 10' is shown in FIG. 25–FIG. 27, and a connector housing 10" is shown in FIG. 31.

The connector housings 10,10',10" have respective peripheral walls 12,12',12". The peripheral walls 12,12',12", respectively, have ceiling walls 12*a*, other ceiling walls 12*a'* lower than the ceiling walls 12*a*, bottom walls 12*b* being basewalls 12*b*,12*b'*, sidewalls 12*c*,12*c'*,12*c"*, other sidewalls 15*c*,15*d*, and still another sidewalls 12*ca*. And, the connector housings 10,10',10" have respective mating connector accommodating portions 17,17', namely mating connector accommodating chambers, and openings 12*d*,12*d'*.

As shown in FIG. 2–FIG. 4, FIG. 25–FIG. 27, and FIG. 31, slant guide planes 12*h* are provided at the peripheries of the openings 12*d*,12*d*' of the connector housings 10,10',10" so as to facilitate the coupling of the connectors C1,C2.

Figure 2:
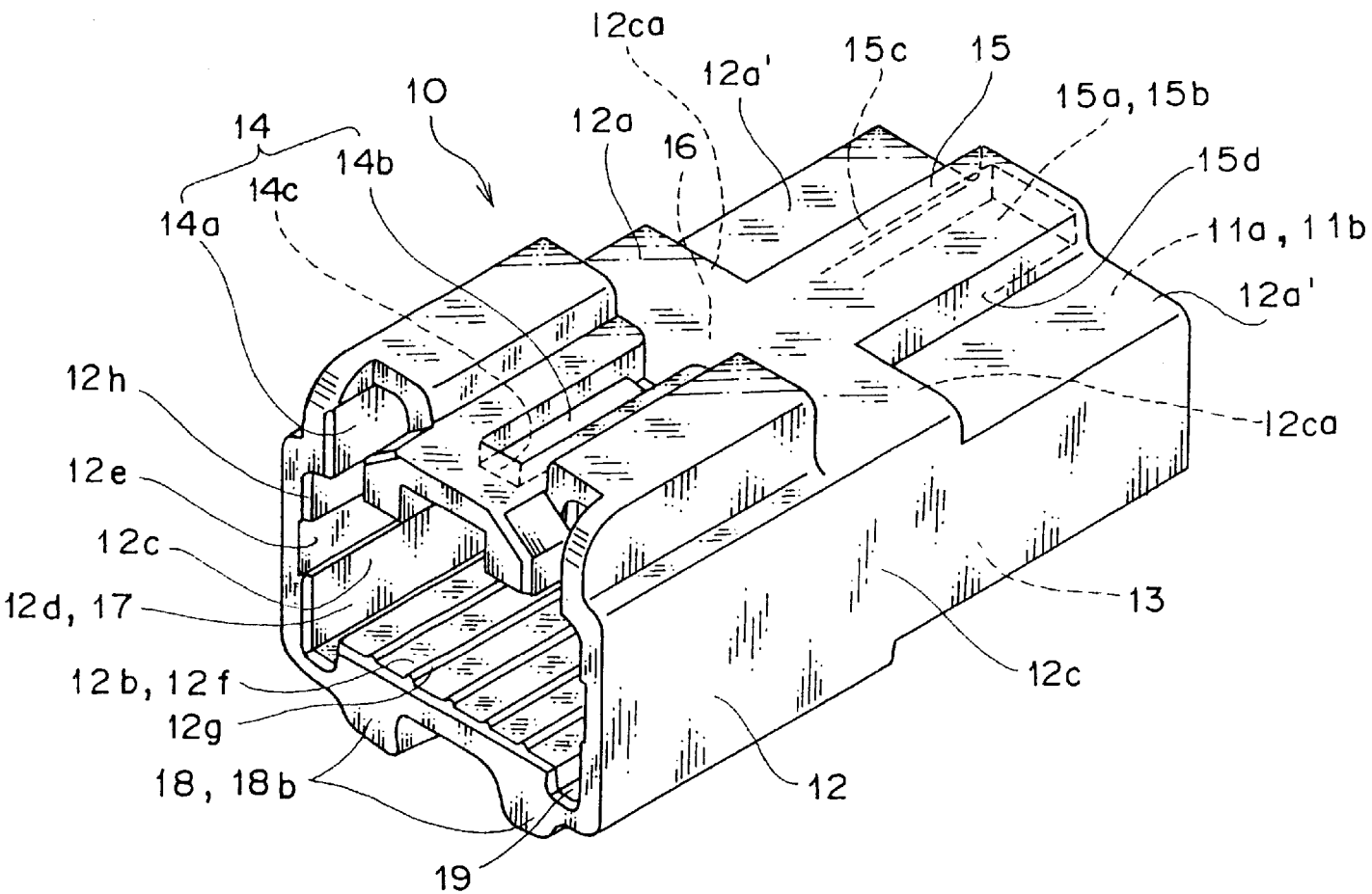
FIG. 2 is a perspective view showing a connector housing.
Figure 3:
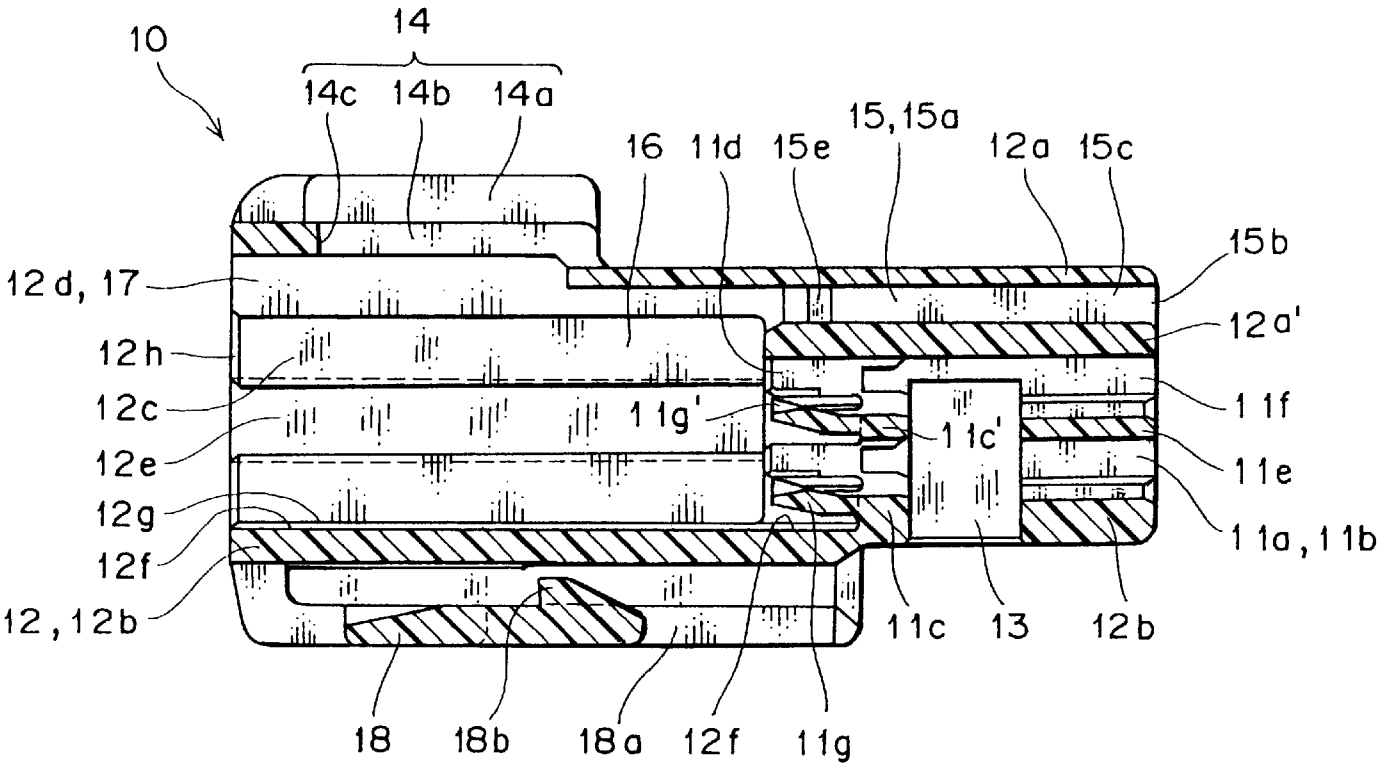
FIG. 3 is a longitudinal sectional view showing the connector housing.
Figure 4:
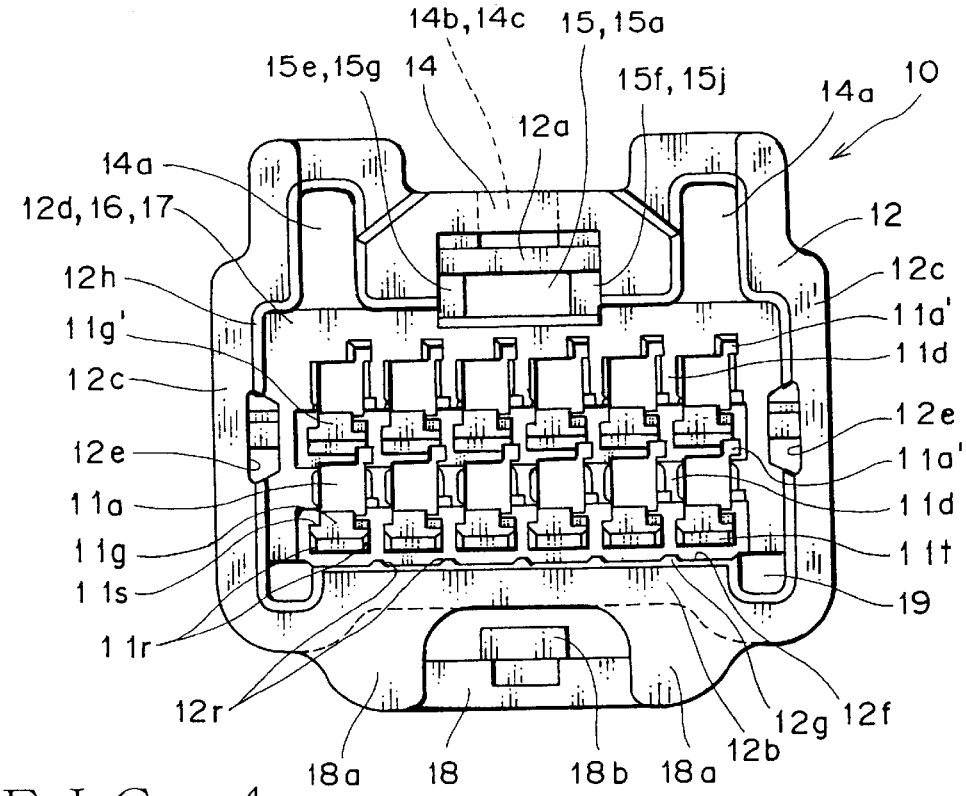
FIG. 4 is a front view showing the connector housing.
Figure 13:
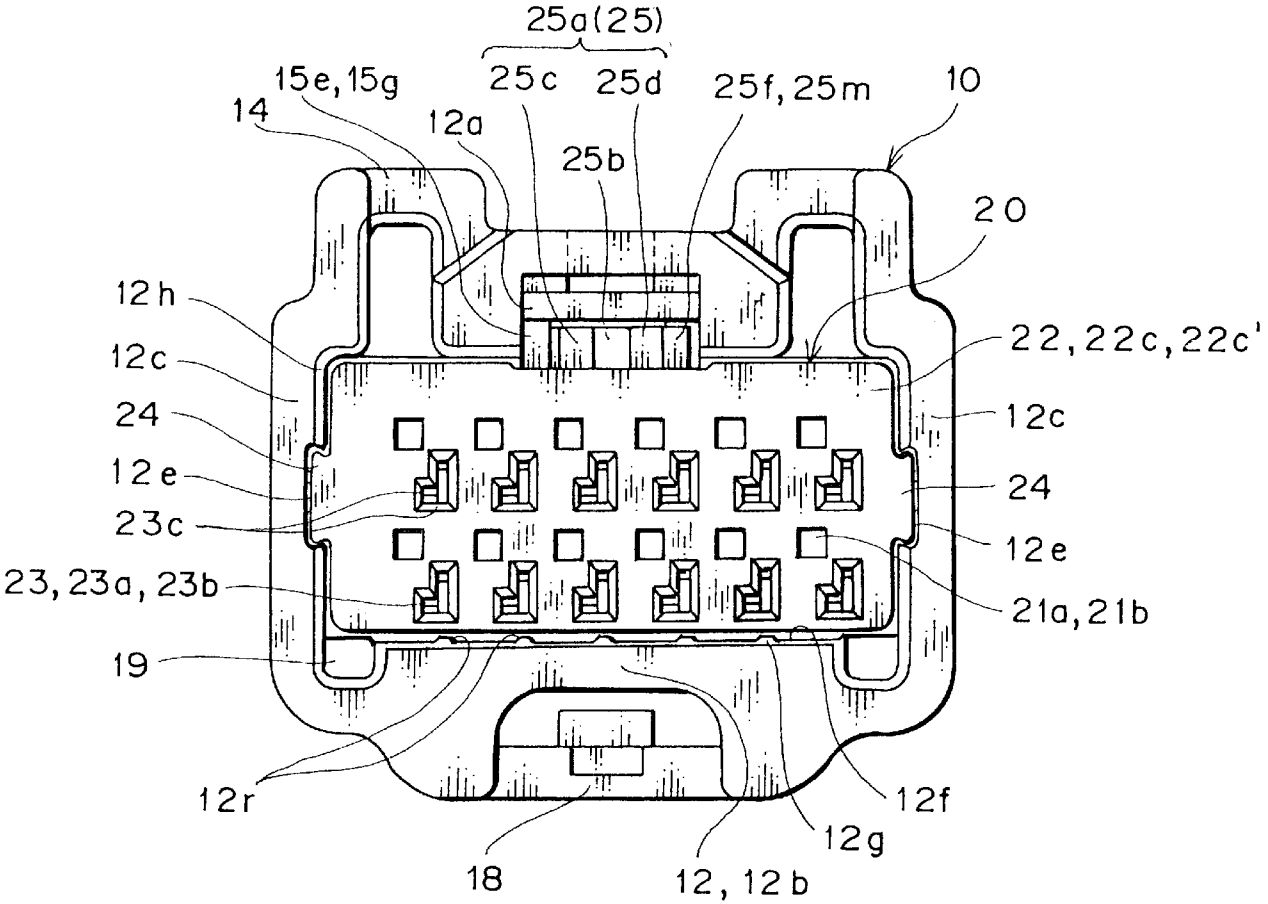
FIG. 13 is a front view showing the connector housing with the front holder.

And, as understood from FIG. 1–FIG. 4, FIG. 25–FIG. 27, and FIG. 31, in the connector housings 10,10', 10", terminal accommodating portions 11*a*, spacer accommodating portions 13 (FIG. 3, FIG. 26), arm accommodating portions 15 for the holders 20, and the holder body accommodating portions 16,16' are formed. And, as for the connector housing 10 shown in FIG. 1–FIG. 5, a relief portion 12*f* (multi-groove 12*f*) to secure a bending amount of the lower locking lance 11*g* is provided on an inner surface of the bottom wall 12*b*. As shown in FIG. 4 and FIG. 13, a slanting plane 12*r* is formed on each side of the relief groove 12*f*.

As shown in FIG. 1–FIG. 3, FIG. 25, FIG. 26, and FIG. 31, the arm accommodating portion 15 is surrounded with a part of the ceiling wall 12*a* and the sidewalls 15*c*,15*d* so as to form the arm accommodating chamber 15*a*. A rear opening 15*b* is provided on the rear of the arm accommodating chamber 15*a*, from which rear opening 15*b* a jig (not shown) to release the final engagement of the front holder 20 is inserted.

Further as shown in FIG. 1–FIG. 4, FIG. 25–FIG. 27, and FIG. 31, an engaging lock portion 14 is provided on each front upper portion of the ceiling wall 12*a* of the connector housings 10,10',10", and a lock portion 18 is provided on each front lower portion of the bottom walls 12*b*,12*b*' of the connector housings 10,10',10".

And, as shown in FIG. 1–FIG. 3, FIG. 25, FIG. 26 and FIG. 31, a plurality of terminal accommodating portions 11*a* (terminal accommodating chambers) are provided on the rear portion of each of the connector housings 10,10',10". Each terminal accommodating portions 11*a* has a rear opening 11*b* from which the male terminal 40 (FIG. 10, FIG. 14–FIG. 16) is inserted, and the cable 50 (FIG. 15, FIG. 16) connected to the male terminal 40 is led out from the rear opening 11*b*.

As shown in FIG. 3 and FIG. 26, each terminal accommodating chamber 11*a* is formed with a horizontal partition wall 11*c* (11*c*') continuing from the locking lance 11*g* (11*g*'), a vertical partition wall 11*d* positioned ahead of the spacer accommodating portion 13, a rear side horizontal partition wall 11*e* positioned behind the spacer accommodating portion 13, and a rear side vertical partition wall 11*f*.

Figure 10:
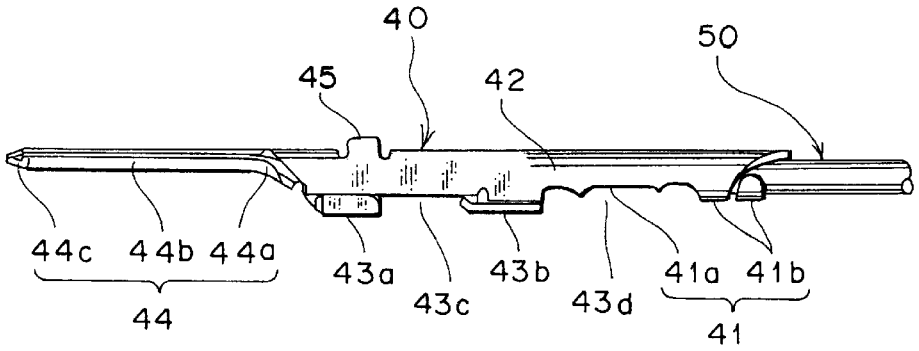
FIG. 10 is a side view showing an assembly state of a male terminal and a wire.

Correspondingly to a positioning projection 45 of the male terminal 40 shown in FIG. 10, FIG. 14–FIG. 17, FIG. 29, and FIG. 30, a positioning groove 11*a*' determining an insertion direction of the terminal is formed in each terminal accommodating chamber 11*a* of the connector housings 10,10' as shown in FIG. 4 and FIG. 27. By this, the male terminal 40 shown in FIG. 10 is properly inserted in the terminal accommodating chamber 11*a* of the connector housings 10,10',10" as shown in FIG. 14–FIG. 17, FIG. 29, and FIG. 30. Here, as for the Q'—Q' section shown in FIG. 30, the connector of FIG. 30 has the same structure as that of the F portion (FIG. 17) at the section Q'—Q' in FIG. 30.

As shown in FIG. 3–FIG. 5, FIG. 14–FIG. 16, FIG. 19, FIG. 20, FIG. 26, FIG. 27, FIG. 29, and FIG. 30, the lances positioned at the upper side of the respective connector housings 10,10' are shown at 11*g*' and positioned at the bottom side thereof are shown at 11*g*.

Figure 14:
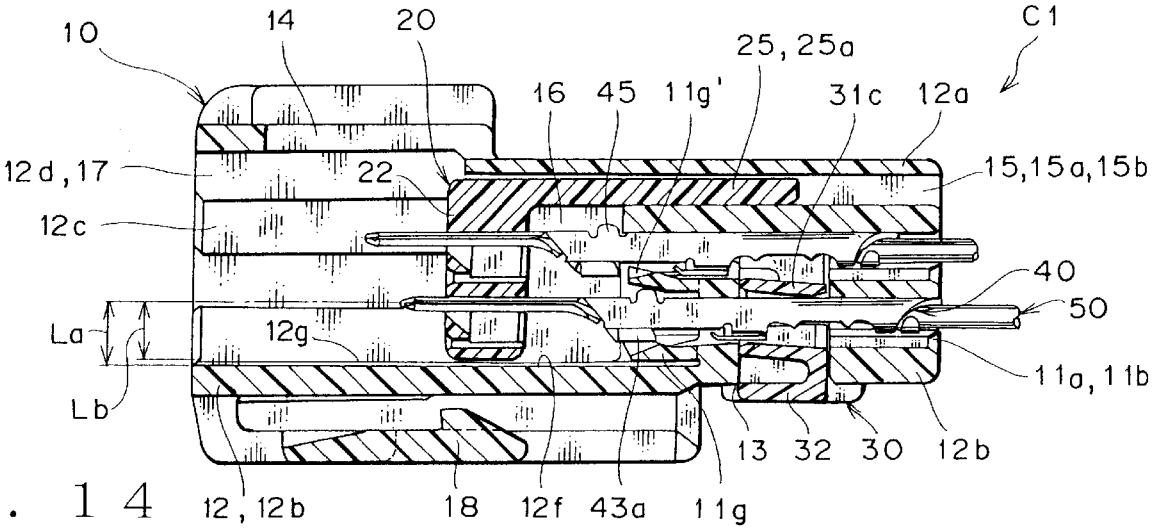
FIG. 14 is a longitudinal sectional view showing a state that the male terminal is primarily-locked in the connector housing.
Figure 29:
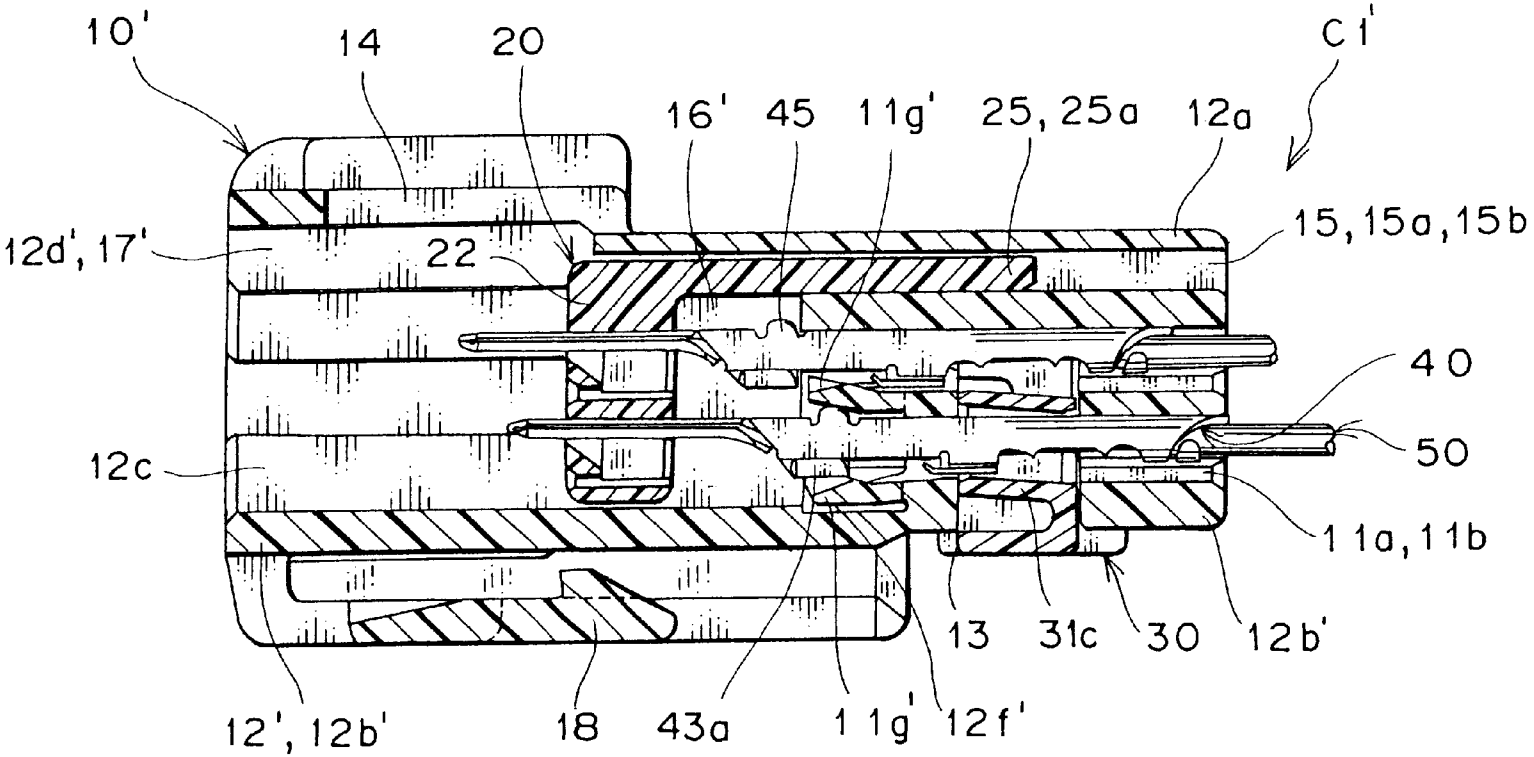
FIG. 29 is a longitudinal sectional view showing a state that the male terminal is primarily-locked in the connector housing of FIG. 25.

As shown in FIG. 14 or FIG. 29, the locking lance 11*g* provided on the lower terminal accommodating chamber 11*a* in each of the connector housings 10,10' is pressed by a provisionally engaging projection 43*a* provided at the front side of the terminal 40 and bent downwardly when the terminal 40 is inserted in the terminal accommodating chamber 11*a* of each of the connector housings 10,10'. Subsequently, as shown in FIG. 15 or FIG. 30, the provisionally engaging projection 43*a* get over the locking lance 11*g*.

Figure 15:
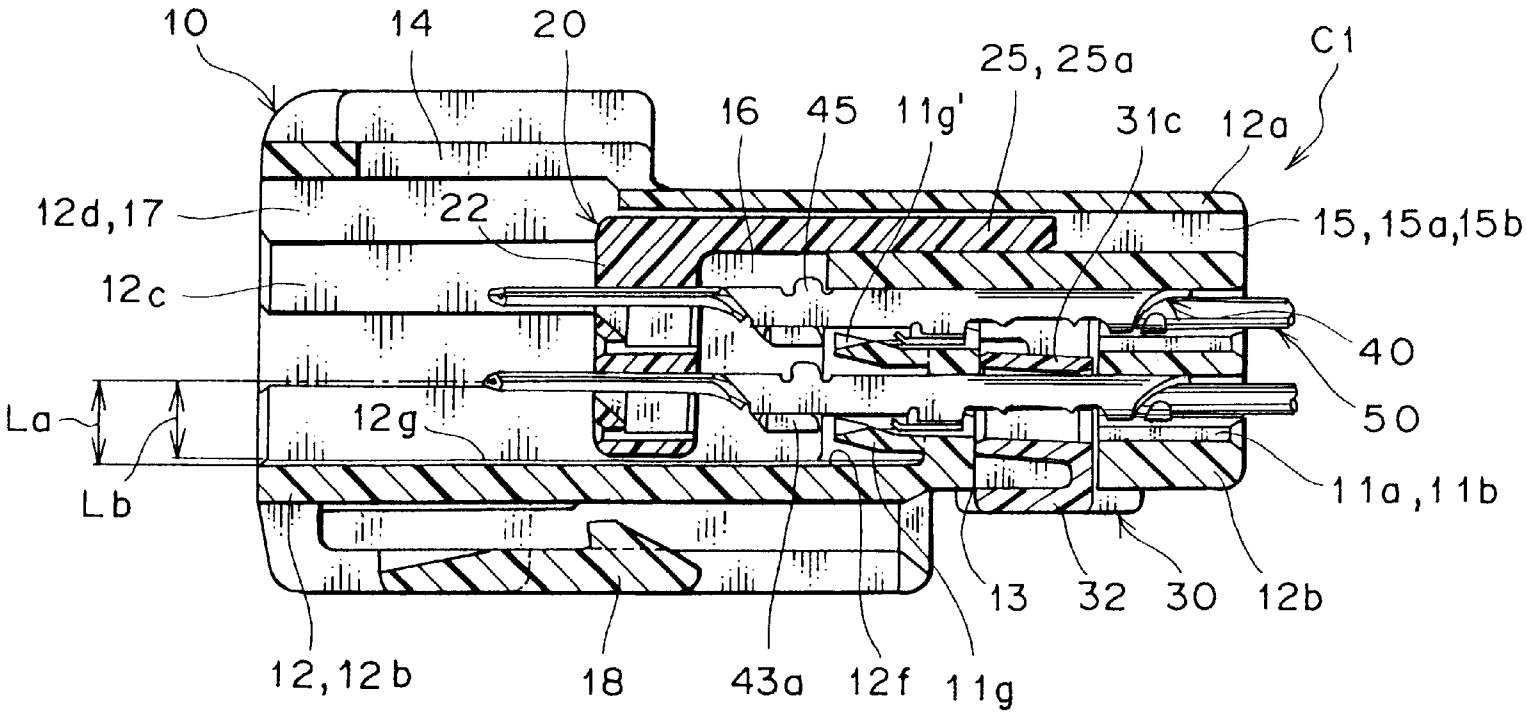
FIG. 15 is a longitudinal sectional view showing a state that the male terminals are primarily-locked in the connector housing.
Figure 30:
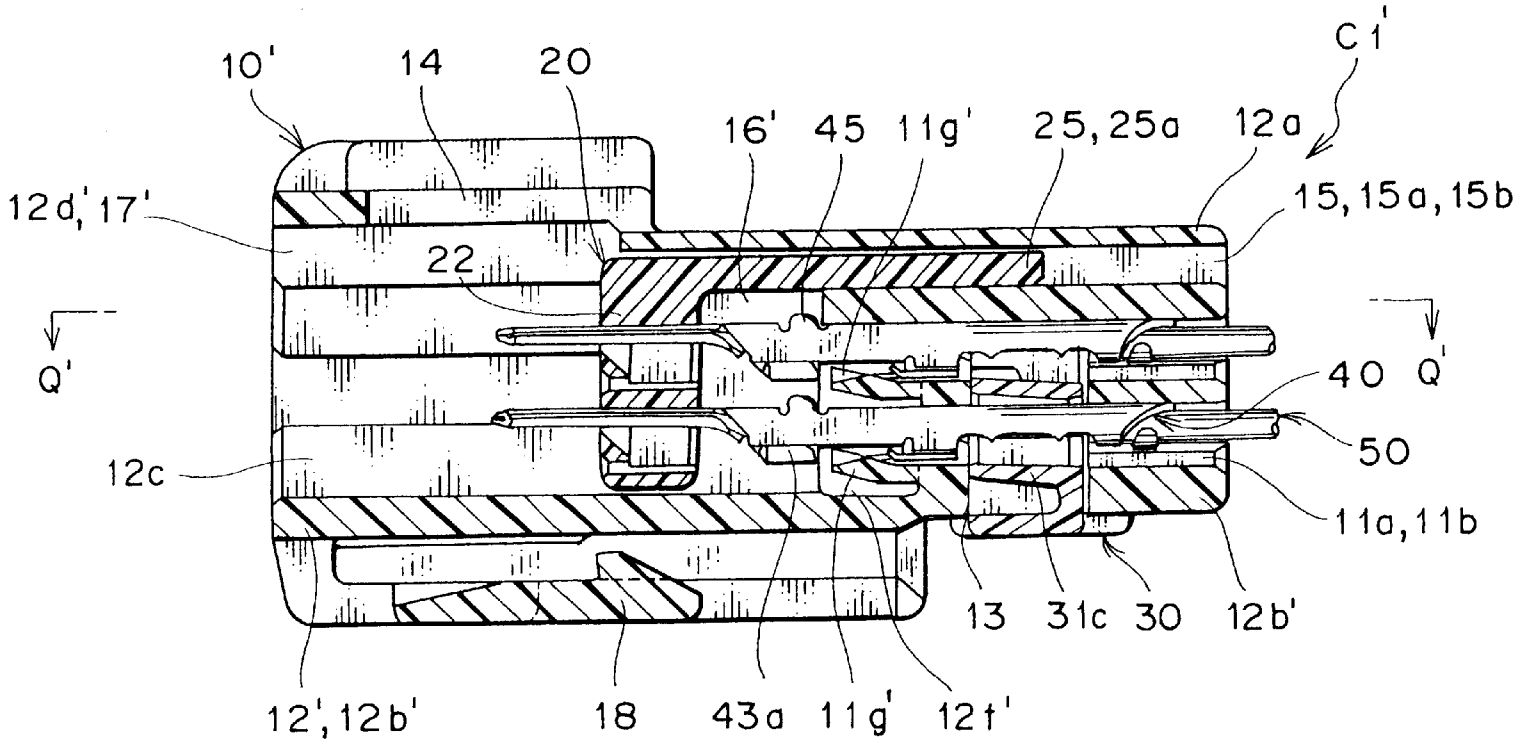
FIG. 30 is a longitudinal sectional view showing a state that the male terminals are primarily-locked in the connector housing of FIG. 25.

And, the locking lance 11*g* resiles as shown in FIG. 15 or FIG. 30. The connector housing 10 is preferably made of synthetic resin with resilience.

The locking lances 11*g*,11*g*' are provided in order to primarily lock the terminals 40 in the terminal accommodating chambers 11*a* of the connector housings 10,10',10".

Figure 6:
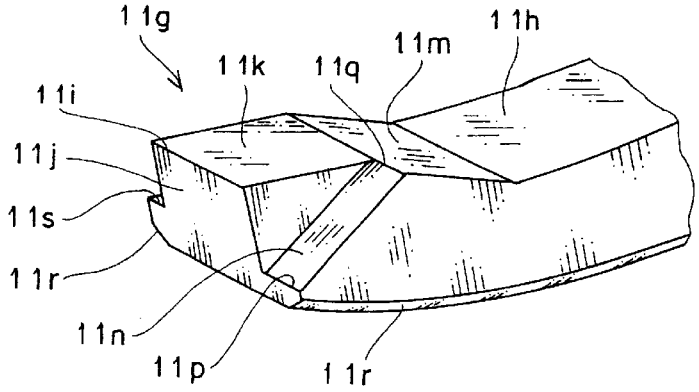
FIG. 6 is a perspective view showing a lance.

As shown in FIG. 6, the locking lance 11*g* has a straight portion 11*h* and an engaging projection 11*i*. The engaging projection 11*i* has a front end surface 11*j*, a front slanting plane 11*k*, a rear slanting plane 11*m* and a tapered guide slanting plane 11*n*. The tapered guide slanting plane 11*n* has a front end 11*p* and a rear end 11*q*. And, as shown in FIG. 4 and FIG. 6, a pair of tapered planes 11*r* are formed on the lower side of the locking lance 11*g*, and a cutout portion 11*s* is formed on the one side of the locking lance 11*g*. And, as shown in FIG. 4, FIG. 27, under surfaces 11*t*, 11*t*' are formed on the respective locking lances 11*g*, 11*g*'.

Referring to FIG. 6, an end of a jig (not shown) is put on the guide slanting plane 11*n* provided on the terminal locking lance 11*g* and advanced toward the straight portion 11*h* of the locking lance 11*g* so that the locking lance 11*g* is bent toward downwardly. With this, the front end surface 11*j* of the locking lance 11*g* is disengaged from the provisionally engaging projection 43*a* (FIG. 10) of the male terminal 40, and the primary locking of the male terminal 40 is released.

The upper locking lances 11*g*' of the connector housings 10,10' shown in FIG. 16–FIG. 14, FIG. 29, and FIG. 30 are disengaged similarly. And, the locking lance 61*g* provided in the connector housing 60 shown in FIG. 19 is similarly disengaged from the female terminal 90.

The spacer accommodating portions 13 of the connector housings 10,10' shown in FIG. 3 and FIG. 26 are for the spacers 30 shown in FIG. 1, FIG. 8, FIG. 16, FIG. 20, and FIG. 30.

Figure 8:
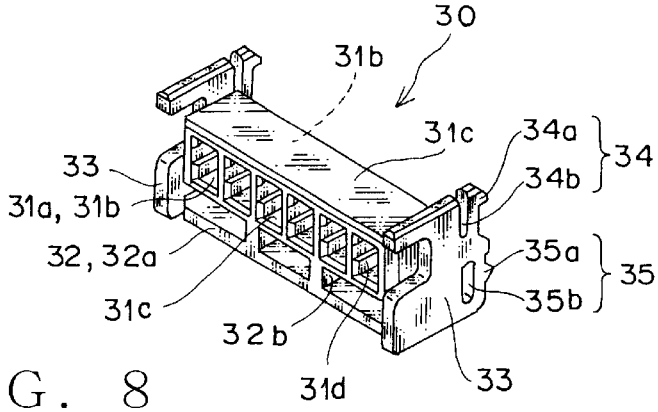
FIG. 8 is a perspective view showing a spacer.

Correspondingly to a provisionally engaging portion 34 provided on a pair of engaging pieces 33 of the spacer 30 shown in FIG. 8, a pair of provisionally engaging projections are formed in the spacer accommodating portion 13 of the connector housings 10,10'. And, correspondingly to a finally engaging portion 35 provided on a pair of engaging pieces 33 of the spacer 30 shown in FIG. 8, a pair of finally engaging projections are formed in the spacer accommodating portion 13 of the connector housing 10. Here, in FIG. 3 and FIG. 26, the pairs of provisionally engaging projections and the finally engaging projection provided on the spacer accommodating portion 13 of the connector housings 10,10' are located behind the respective rear side vertical partition walls 11*f*.

As shown in FIG. 1–FIG. 4, FIG. 14–FIG. 16, FIG. 20, FIG. 25 FIG. 27, and FIG. 29–FIG. 31, an engaging lock portion 14 is provided in front of each ceiling wall 12*a* of the connector housings 10,10',10". The above engaging lock portion 14 engages an engaging lock portion 64 of each of the connector housings 60 shown in FIG. 1, FIG. 9, FIG. 19–FIG. 22, and FIG. 24.

As shown in FIG. 2, FIG. 3, FIG. 25, FIG. 26, and FIG. 31, each engaging lock portion 14 of the connector housings 10,10',10" has a pair of guide recesses 14*a*, an engaging recess 14*b* and an engaging plane 14*c* provided on the engaging recess 14*b*.

Figure 9:
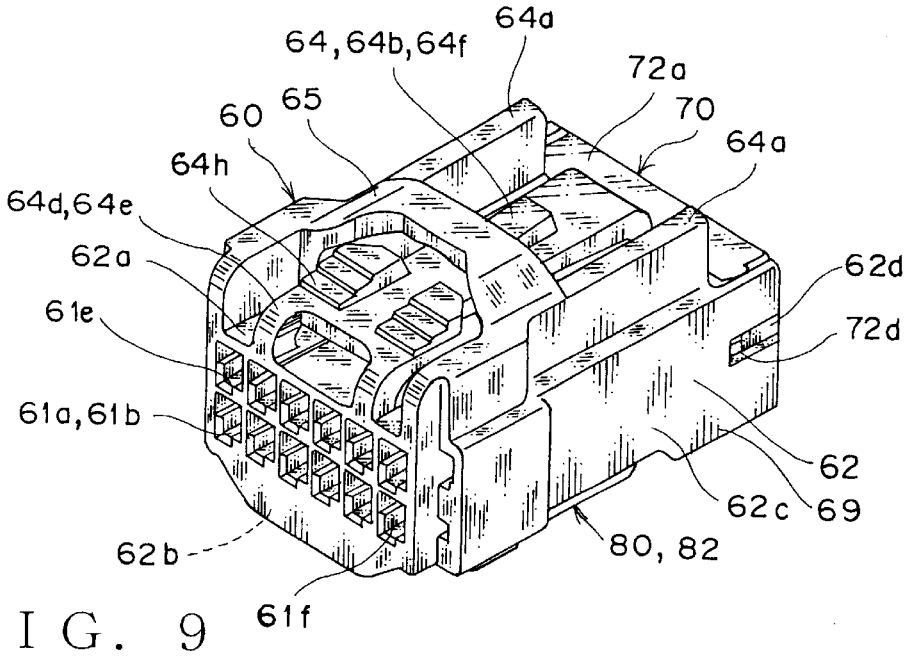
FIG. 9 is a perspective view showing a state that another front holder and another spacer are assembled to the other connector housing.

And, correspondingly to a pair of guiding projecting portions 69 provided on the front lower portions the connector housing 60 shown in FIG. 9 and FIG. 19, a pair of guiding grooves 19 are provided on the lower portion in the connector accommodating portions 17,17' of the connector housings 10,10',10" as shown in FIG. 2, FIG. 4, FIG. 13, FIG. 25, FIG. 27, FIG. 28 and FIG. 31.

And, as shown in FIG. 1–FIG. 3, FIG. 17, FIG. 25, FIG. 26 and FIG. 31, front holder body accommodating portions 16,16' are provided in an intermediate portion of the connector housings 10,10',10". Further, an arm accommodating portion 15 is provided at the rear upper portion of the connector housings 10,10',10". The body portion 22 of the front holder 20 shown in FIG. 1 and FIG. 7 and the arm portion 25 are accommodated in the front holder body accommodating portion 16 or 16' and the arm accommodating portion 15, respectively.

And, correspondingly to a pair of approaching portions 24 (FIG. 1, FIG. 7, FIG. 13 and FIG. 28) provided on both side of the body portion 22 of the front holder 20, a pair of approaching portion guiding grooves 12*e* are provided inside the connector housings 10,10',10" as shown in FIG. 1–FIG. 4, FIG. 13, FIG. 25–FIG. 28 and FIG. 31.

And, as shown in FIG. 1–FIG. 3, FIG. 14–FIG. 16, and FIG. 25 FIG. 31, another lock portion 18 is provided on the connector housings 10,10',10". As shown in FIG. 3 or FIG. 26, the lock portion 18 has a locking arm 18*a* and an engaging projection 18*b*. The lock portion 18 is used for attaching the connector C1 to a vehicle body.

The front holders 20 are inserted in the connector housings 10,10',10" from the front openings 12*d*,12*d*' in an attaching direction S2 (FIG. 1) which is the same as the coupling direction S2(S4) (FIG. 20) of the connectors.

Figure 7:
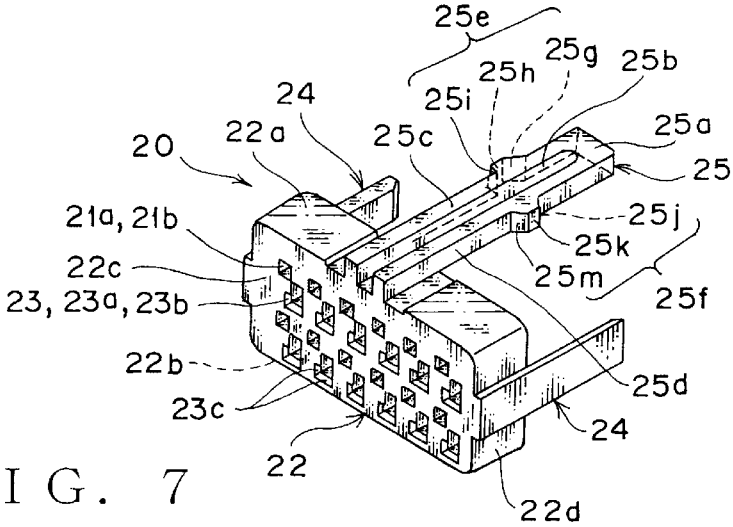
FIG. 7 is a perspective view showing a front holder.

As shown in FIG. 1 and FIG. 7, the front holder 20 has the body portion 22, the arm portion 25 and the pair of approaching portions 24. And, as shown in FIG. 7 and FIG. 16, the body portion 22 of the front holder 20 has the ceiling wall 22*a*, the bottom wall 22*b*, the front wall 22*c*, the sidewalls 22*d* and the horizontal partition wall 21*c* (FIG. 16).

And, as shown in FIG. 7 and FIG. 13, jig passing-through portions 23 and electrical contact portion projecting openings 21*b* are provided on the body portion 22 of the front holder 20. As shown in FIG. 16, the electrical contact portion projecting opening 21*b* is bored through the front wall 22*c* of the front holder 20 so that the electrical contact portion 44 (the male tab) of the male terminal 40 can be put through the electrical contact portion projecting opening 21*b*.

Also as shown in FIG. 16, terminal passing-through portions 21*a* are provided inside the body portion 22 of the front holder 20. The terminal passing-through portion 21*a* continues from the electrical contact portion projecting opening 21*b*.

The horizontal partition wall 21*c* tabularly extends from one sidewall 22*d* to the other sidewall 22*d*.

And, as shown in FIG. 7, FIG. 13, and FIG. 16, a jig insertion hole 23*a* and a jig insertion opening 23*b* are provided on the front wall 22*c* of the front holder 20. As shown in FIG. 16, a guide groove 23*d* continuing from the above jig insertion hole 23*a* is provided on the upper surface of the bottom wall 22*b* and on the upper surface of the horizontal partition wall 21*c* of the front holder 20.

As shown in FIG. 7 and FIG. 13, a tapered guide plane 23*c* is formed on the jig insertion opening 23*b* provided on the front wall 22*c* of the front holder 20 so that the jig (not shown) can be easily inserted.

The front holder 20 shown in FIG. 1 moves in its attaching direction S2 and is attached to the connector housing 10 as shown in FIG. 13 . FIG. 16.

And, as shown in FIG. 1 and FIG. 7, the cantilever arm 25 projects from the ceiling wall 22*a* of the front holder 20.

When the connectors C1,C2 shown in FIG. 20–FIG. 24 are coupled, the cantilever arm 25 of the front holder 20 enters the arm accommodating portion 15 of the connector housing 10 shown in FIG. 1, FIG. 2, FIG. 14–FIG. 17.

The cantilever arm 25 provided on the front holder 20 will be described with reference to FIG. 7, FIG. 17, and FIG. 18. A provisionally engaging projection 25*e* is provided on one frame 25*c* of a generally U-shaped resiliently transformable frame 25*a* of the cantilever arm 25, and a finally engaging projection 25*f* is provided on the other frame 25*d* thereof. The resiliently transformable frame 25*a* has a bending space 25*b* therein. The provisional engagement and the final engagement of the front holder 20 are carried out with the cantilever arm 25.

Figure 18:
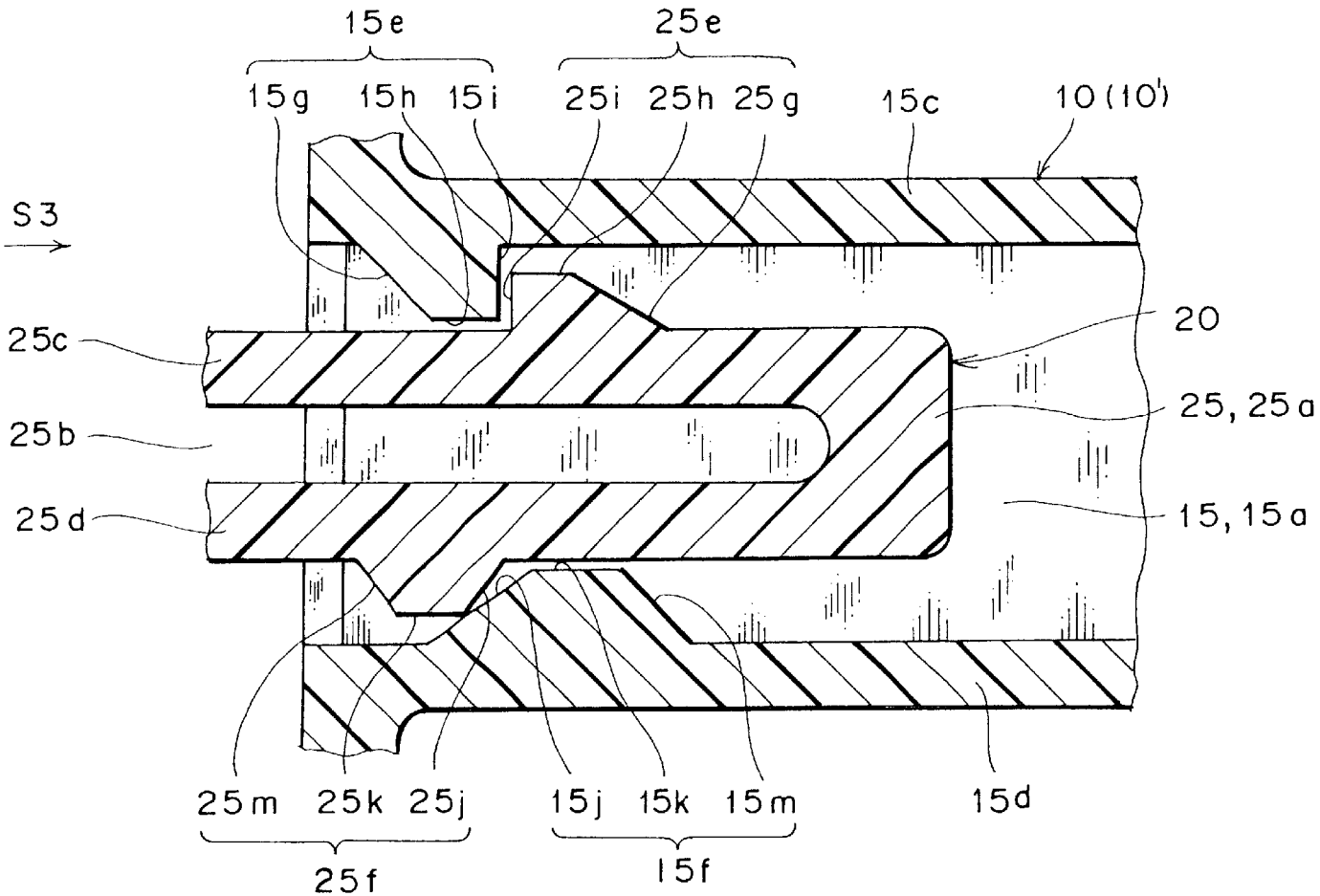
FIG. 18 is an enlarged sectional view of the F-portion of FIG. 17.

As shown in FIG. 7 and FIG. 18, the provisionally engaging projection 25*e* provided on the resiliently transformable frame 25*a* of the cantilever arm 25 of the front holder 20 has a slant slide plane 25*g*, a slide plane 25*h* and an engaging plane 25*i*. And, the finally engaging projection 25*f* provided on the resiliently transformable frame 25*a* of the cantilever arm 25 of the front holder 20 has a rear slant slide plane 25*j*, a slide plane 25*k* and a front slant slide plane 25*m*.

Figure 17:
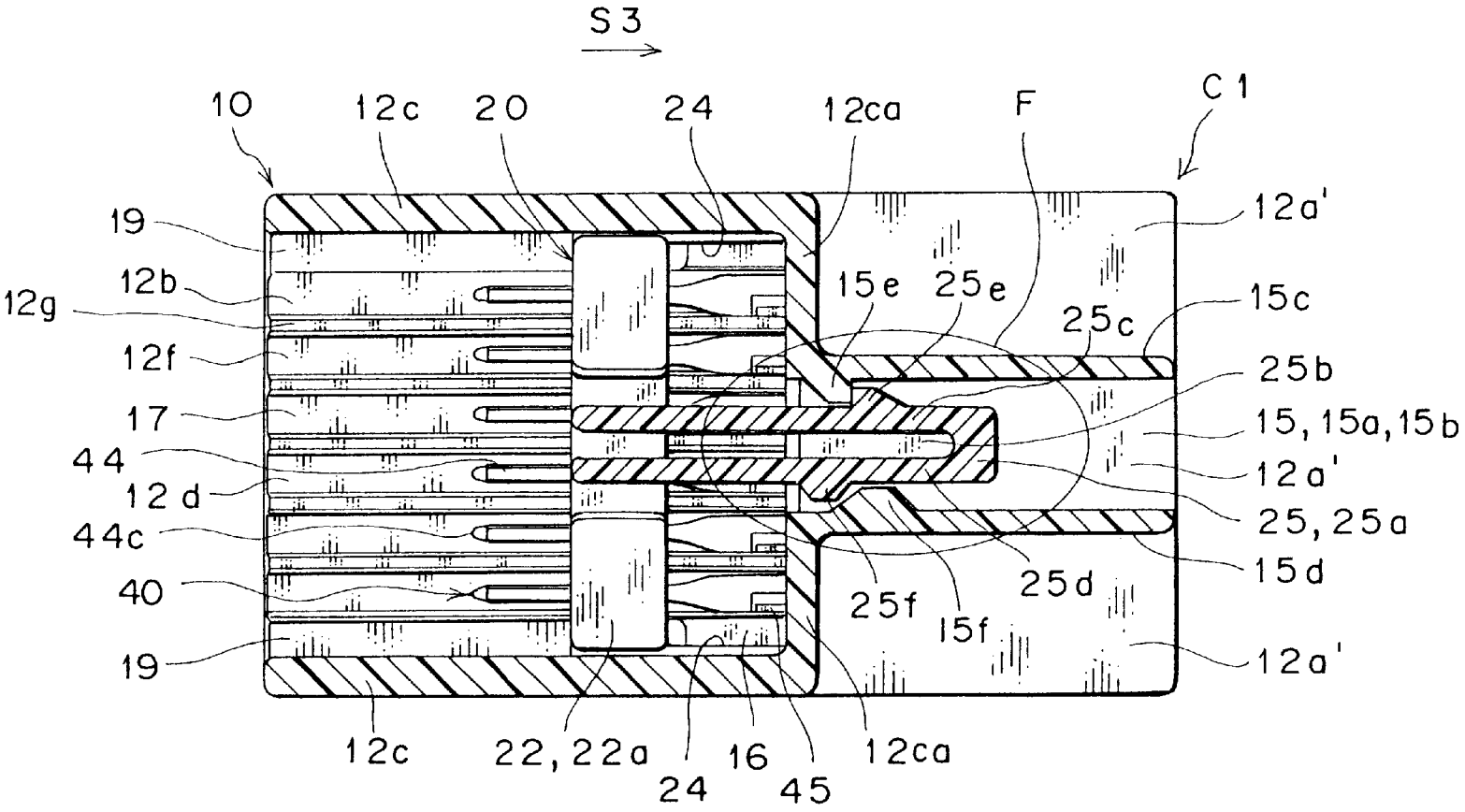
FIG. 17 is a sectional view taken along the line Q—Q of FIG. 16.

Referring to FIG. 17 and FIG. 18, the cantilever arm 25 of the front holder 20 is provisionally engaged in the arm accommodating portion 15 of the connector housing 10 (10'). Correspondingly to the provisionally engaging projection 25*e* of the front holder 20, a provisionally engaging projection 15*e* is formed on a sidewall 15*c* of the arm accommodating portion 15 of the connector housing 10. And, correspondingly to the finally engaging projection 25*f* of the front holder 20, a finally engaging projection 15*f* is formed on another sidewall 15*d* of the arm accommodating portion 15 of the connector housing 10.

Referring to FIG. 18, the provisionally engaging projection 15*e* of the connector housing 10 (10') has a slant slide plane 15*g*, a slide plane 15*h* and an engaging plane 15*i*. And, the finally engaging projection 15*f* of the connector housing 10 (10') has a front slant slide plane 15*j*, a slide plane 15*k* and a rear slant slide plane 15*m*.

As shown in FIG. 17 and FIG. 18, the cantilever arm 25 of the front holder 20 easily finally engages with, and is easily released from, the arm accommodating portion 15 of the connector housing 10 (10').

When the cantilever arm 25 of the front holder 20 shifts in the sliding direction S3 (FIG. 17), the finally engaging projection 25*f* moves inwardly of the bending space 25*b* and gets over the finally engaging projection 15*f* of the arm accommodating chamber 15*a* of the connector housing 10 (10').

When the front holder 20 is returned to the provisional engagement state from the final engagement state, the rear end of the cantilever arm 25 of the front holder 20 is pressed by a jig (not shown) inserted from the rear opening 15*b* of the arm accommodating chamber 15*a* of the front holder 20 shown in FIG. 1, FIG. 2, FIG. 16, and FIG. 17.

Referring to FIG. 18, in the provisional engagement state, since an engaging plane 25*i* of the provisionally engaging projection 25*e* of the cantilever arm 25 of the front holder 20 engages an engaging plane 15*i* of the provisionally engaging projection 15*e* of the arm accommodating portion 15 of the connector housing 10 (10') as shown, the front holder 20 can not slip off from the connector housing 10 (10').

Next, the spacer 30 shown in FIG. 1, FIG. 8, FIG. 16 and FIG. 30 is described. The spacer 30 secondarily locks the terminal 40 in the terminal accommodating chamber 11*a* of the connector housing 10 (10') of the connector C1 (C1').

As shown in FIG. 16 and FIG. 20, the terminal 40 is double-locked to the connector housing 10 by the spacer 30. The spacer 30 has terminal accommodating portions 31*a*, opening portions 31*b*, an operating portion 32 and a pair of engaging projecting pieces 33.

The pair of engaging projecting pieces 33 of the spacer 30 are retained by a pair of engaging portions (not shown) provided inside the connector housing 10 (10'). Referring to FIG. 1 and FIG. 8, the operating portion 32 of the spacer 30 has a baseplate 32*a* and support plates 32*b*,32*c* (FIG. 16) upstanding on the baseplate 32*a*.

Referring to FIG. 8 and FIG. 16, the terminal accommodating portion 31*a* of the spacer 30 is formed with top and bottom slanting partition walls 31*c* and vertical partition walls 31*d* connecting the slanting partition walls 31*c*. The male terminal 40 (FIG. 16) is inserted into the terminal accommodating portion 31*a* through the front and rear opening portions 31*b* (FIG. 8).

As shown in FIG. 8, a provisionally engaging portion 34 consisting of a provisionally engaging projection 34*a* and a bending space 34*b* is provided at the rear upper portion of the engaging projecting piece 33 of the spacer 30. A finally engaging portion 35 consisting of a finally engaging projection 35*a* and a bending space 35*b* is provided at the rear of the engaging projecting piece 33 of the spacer 30.

When the spacer 30 is partly inserted in the spacer accommodating portion 13 of the connector housing 10 (10'), the spacer 30 is provisionally engaged with the connector housing 10 (10').

And, when the spacer 30 is completely inserted in the spacer accommodating portion 13 of the connector housing 10 (10'), the spacer 30 is finally engaged with the connector housing 10 (10').

The provisional engagement state of the spacer 30 of the connector housing 10,10' will be described here. As shown in FIG. 14, FIG. 15, FIG. 29, and FIG. 30, the spacer 30 is retained in the spacer accommodating portion 13 of each of the connector housings 10,10' with the operating portion 32 projecting downwardly.

On the other hand, as shown in FIG. 16, when the spacer 30 is further inserted in the spacer accommodating portion 13 by pushing the operating portion 32 of the spacer 30, the finally engaging projection 35*a* (FIG. 8) provided on the engaging projecting piece 33 of the spacer 30 gets over the finally engaging projection provided on the spacer accommodating portion 13 of the connector housing 10. Like this, the final engagement state of the spacer 30 is attained.

The spacer 30 is provisionally engaged (namely, primary engaged) with the connector housing 10, and subsequently the male terminal 40 (FIG. 10) to which the cable 50 is crimped is inserted in the connector housing 10 and the spacer 30.

And, as shown in FIG. 14 and FIG. 15, the male terminal 40 inserted in the connector housing 10 is primarily-locked by the locking lance 11*g*, the operating portion 32 of the spacer 30 is pressed, and the spacer 30 is secondarily-locked in the spacer accommodating portion 13 of the connector housing 10 as shown in FIG. 16 and FIG. 20. That is, the spacer 30 is finally-engaged in the spacer accommodating portion 13 of the connector housing 10. With the above, the male terminal 40 is secondarily-locked in the connector housing 10 by means of two slanting partition walls 31*c* provided on the spacer 30.

That is, the male terminal 40 is securely double-locked in the connector C1 by the locking lance 11*g* (11*g'*) of the terminal accommodating chamber 11*a* of the connector housing 10 and by the slanting partition wall 31*c* of the spacer 30 secondarily-locked in the connector housing 10. With, this structure, the male terminal 40 can be securely prevented from coming off from the terminal accommodating chamber 11*a* even if the cable 50 is pulled.

The female terminal 90 (FIG. 19) is also double-locked to the connector C2. A provisionally engaging portion and a finally engaging portion are provided on the connector housing 60 shown in FIG. 19, and a provisionally engaging portion and a finally engaging portion are provided on the front holder 70, whereby the front holder 70 engages the connector housing 60. And, the female terminal 90 is securely double-locked by the connector C2 by means of a locking lance 61*g* provided on a terminal accommodating chamber 61*a* of the connector housing 60 and a slanting partition wall 81*c* of a spacer 80 secondarily-locked to the connector housing 60.

Next, the male terminal 40 shown in FIG. 10 is described. The male terminal 40 has a wire connecting portion 41, an electrical contact portion 44, a connecting portion 42 connecting the wire connecting portion 41 and the electrical contact portion 44, the provisionally engaging projection 43*a*, the finally engaging projection 43*b*, and the positioning projection 45.

The wire connecting portion 41 of the male terminal 40 has a conductor crimping piece 41*a* and two cover crimping pieces 41*b*. The electrical contact portion 44 (the male tab) of the male terminal 40 has a root 44*a*, a body 44*b* and a front end 44*c*.

A locking lance accommodating portion 43*c* is provided between the provisionally engaging projection 43*a* and the finally engaging projection 43*b*. A partition wall accommodating portion 43*d* is provided between the finally engaging projection 43*b* and the cover crimping piece 41*b*. The male terminal 40 is secondarily-locked to the connector housing 10 (FIG. 16) with the slanting partition wall 31*c* of the spacer 30 going into the partition wall accommodating portion 43*d* of the male terminal 40.

Relief grooves 12*f* (FIG. 1–FIG. 5), 12*f* (FIG. 25–FIG. 31) securing the bending amount of the terminal locking lances 11*g* provided on the lower side of the connector housings 10,10',10" are provided on the basewalls 12*b*,12*b'* of the connector housings 10,10',10".

The relief grooves 12*f*,12*f'* downsize the connector housings 10,10',10". That is, when the terminals 40 are inserted into the connector housings 10,10',10", the lower locking lances 11*g* are downwardly bent and enter the relief grooves 12*f*,12*f'*, whereby the lower locking lances 11*g* are prevented from interfering with the basewalls 12*b*,12*b'* of the connector housings 10,10',10".

Figure 32:
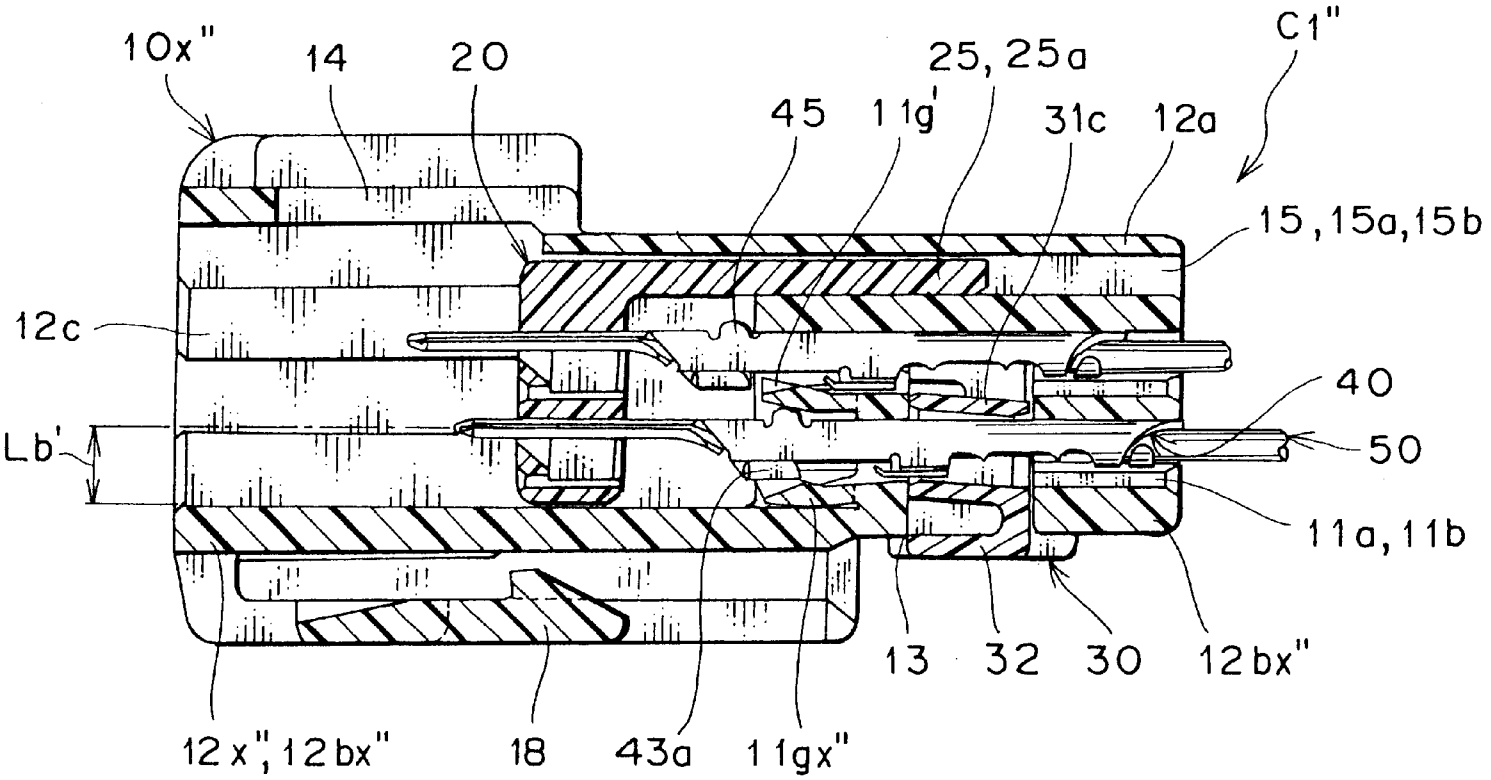
FIG. 32 is a longitudinal sectional view showing a defective connector housing which has an insufficient clearance, under a lower lance, for primarily-locking a male terminal.
Figure 33:
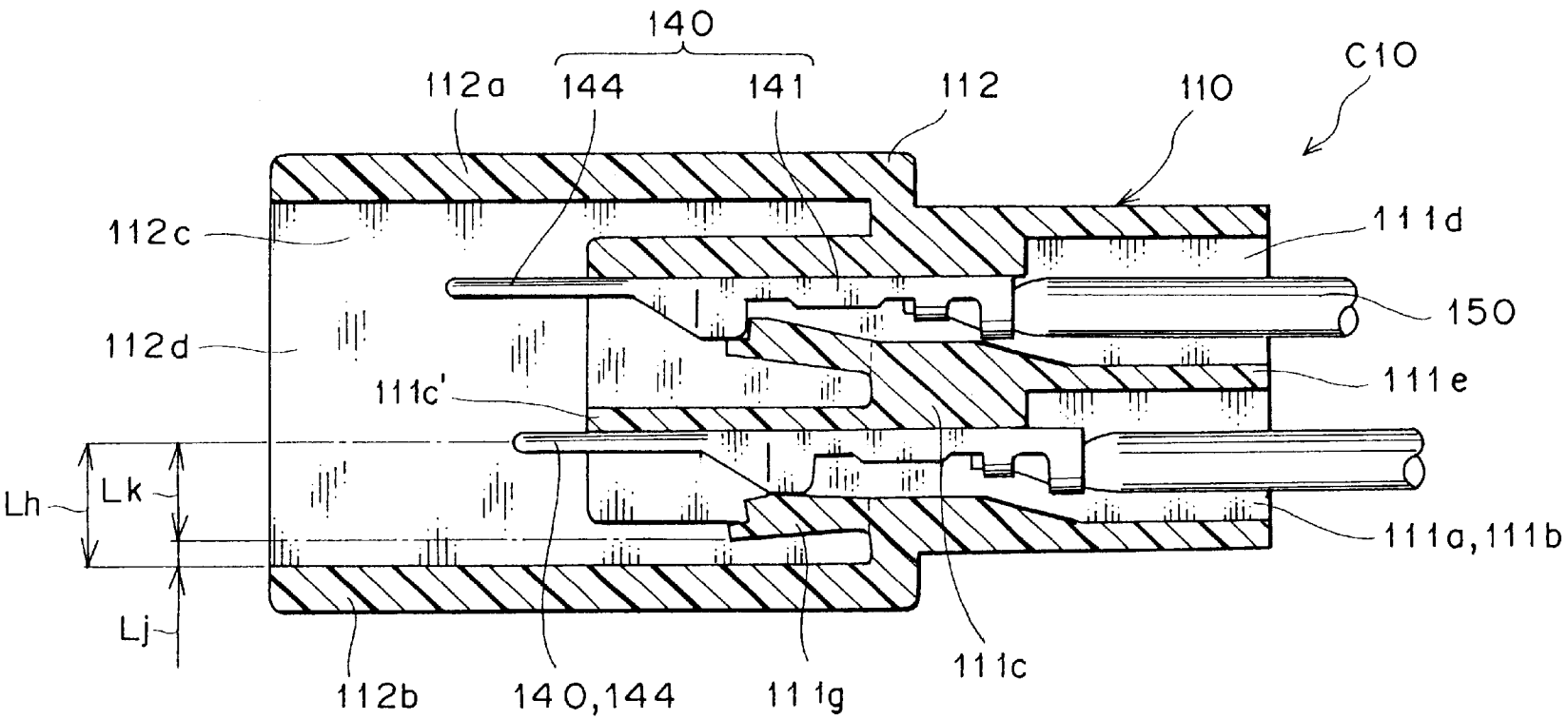
PRIOR ART FIG. 33
FIG. 33 is a longitudinal sectional view showing a state that a male terminal is locked in a connector housing.
Figure 34:
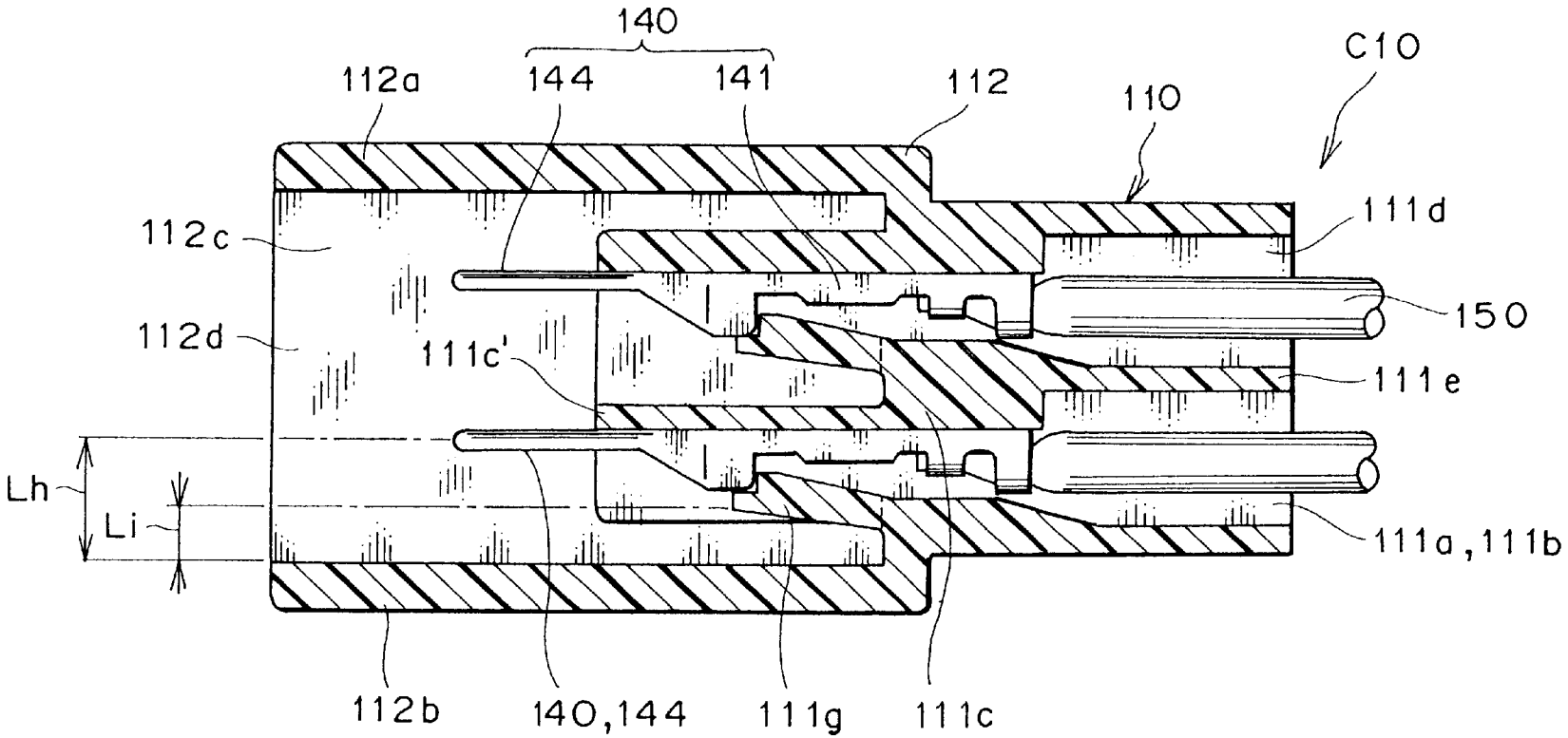
PRIOR ART FIG. 34
FIG. 34 is a longitudinal sectional view showing a state that male terminals are locked in the connector housing.
Figure 35:
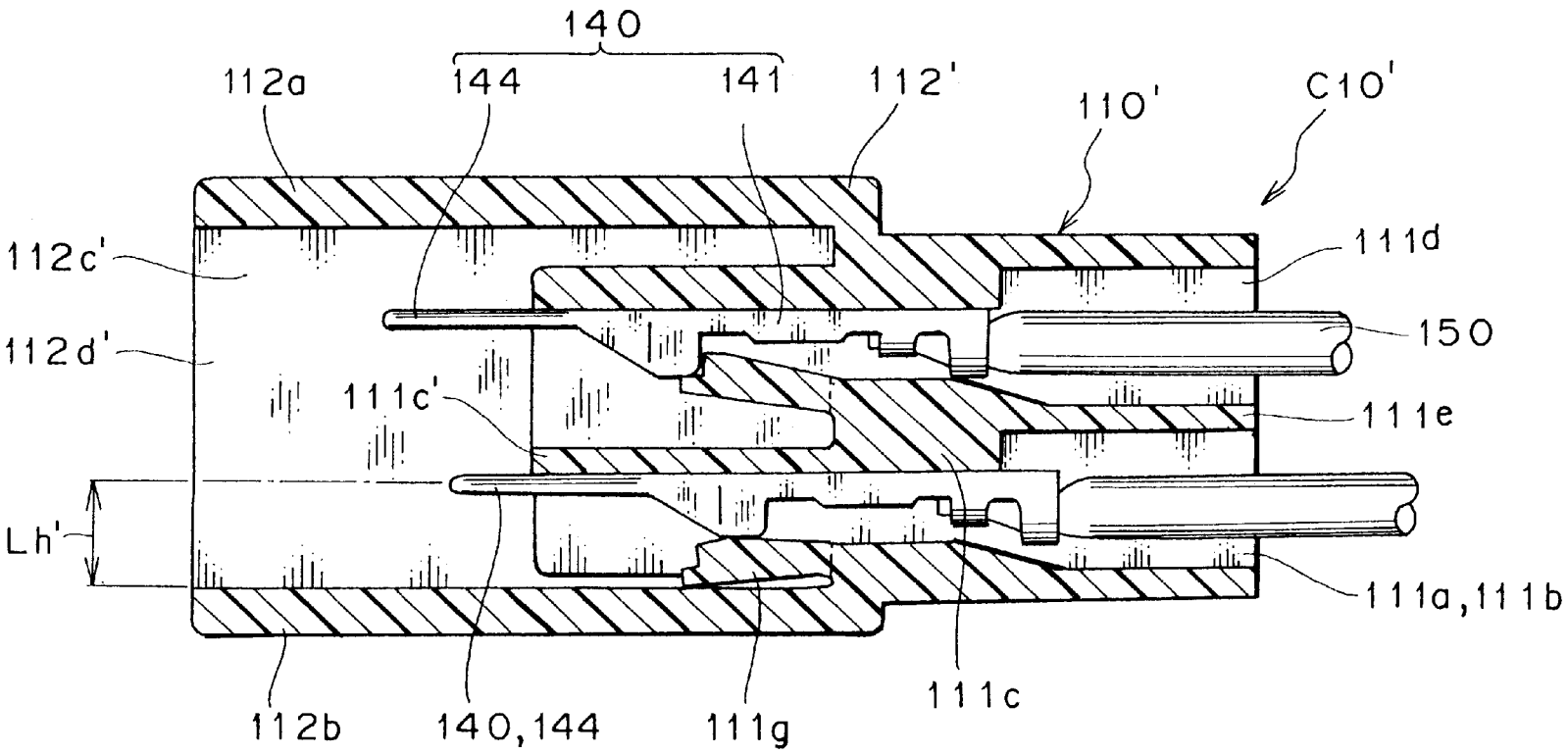
PRIOR ART FIG. 35
FIG. 35 is a longitudinal sectional view showing a defective connector housing which has an insufficient clearance, under a lower lance, for locking a male terminal.

Referring to FIG. 32, the connector housing 10*x"* is not provided with a groove corresponding to the above groove 12*f* for example. The connector 10*x"* has a smaller dimension Lb' from the center of the male terminal to the basewall 12*bx"* of the peripheral wall 12*x"*. The dimension Lb' does not allow the terminal locking lance 11*gx"* to be sufficiently bent when the male terminal 40 is inserted into the connector housing 10*x"*.

Figure 5:
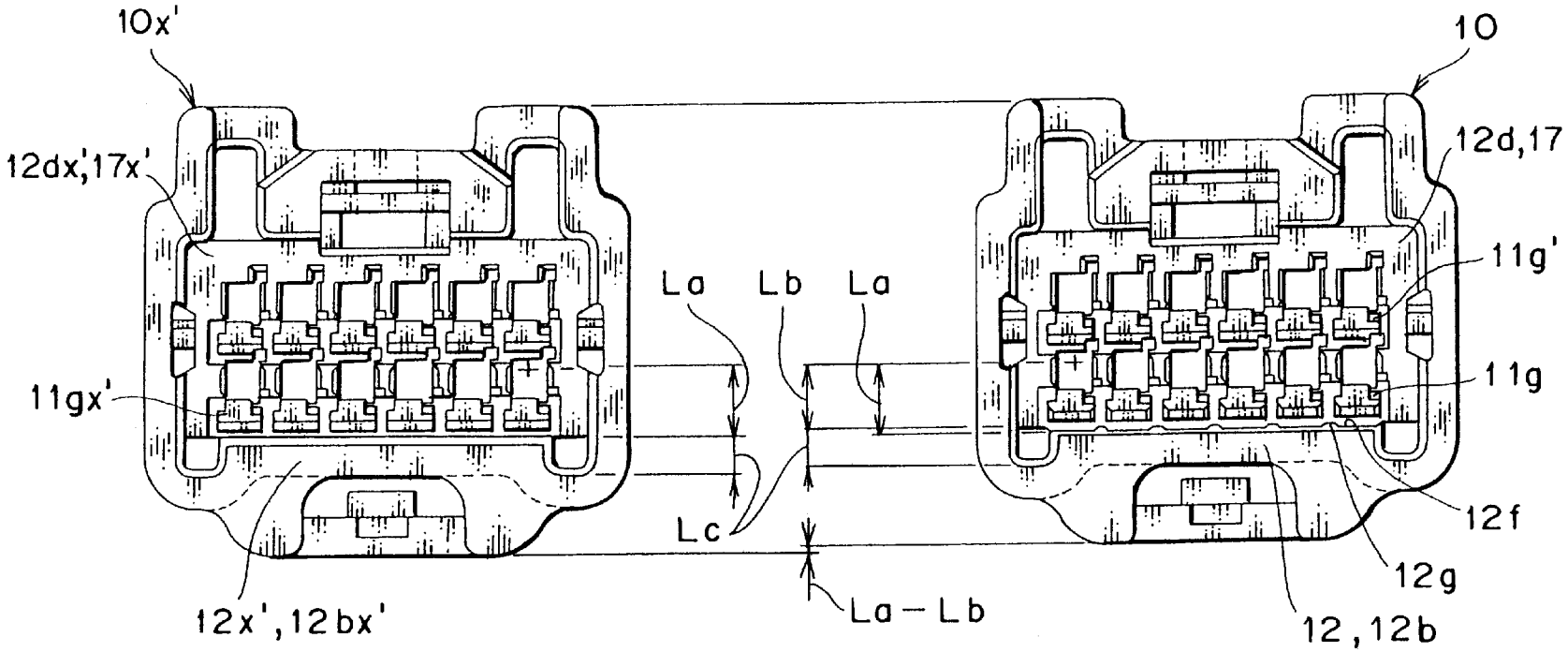
FIG. 5 is a front view also showing the connector housing.

Here, referring to FIG. 5, the inventive connector housing 10 shown in FIG. 1–FIG. 4 is compared with a connector housing 10*x*' (shown for reference). As shown, the connector housing 10 is downsized in a height direction from the connector housing 10*x*'. Specifically, the dimension La (from the center of the male terminal to the surface of the basewall 12*b*) can be shortened to Lb. That is, the height of the housing can be reduced by La—Lb. The above La—Lb is equal to the depth of the multi-groove 12*f*.

Here, the dimension Lc shows the thickness of the basewall 12*b* (including the depth of the groove) of the connector housing 10 and of 12*bx*' of the connector housing 10*x*'.

That inventive holder-equipped connectors C1,C1' do not require a large design change. The locking lances 11*g*, 11*g*' can have the same form as a conventional lance 11*gx*' (FIG. 5). And, the terminal 40 can also be the same one as a conventional one.

According to the above, the connectors C2 (FIG. 19–FIG. 22, FIG. 24) to be inserted into the respective connector accommodating portions 17,17' can also be downsized.

And, the body 22 (FIG. 1, FIG. 7, FIG. 13–FIG. 16, FIG. 28–FIG. 30) of the front holder 20 is downsized.

Referring to FIG. 3, FIG. 14–FIG. 16, the above multi-groove 12*f* provided on the basewall 12*b* of the connector housing 10 is described in detail. The multi-groove 12*f* has a plurality of grooves corresponding to the lower terminal locking lances 11*g* and straightly continuing in the terminal inserting direction from the front opening of the connector housing 10 to the vicinity of the root of the terminal locking lance 11*g*.

As shown in FIG. 4 and FIG. 13, a pair of tapered planes 11*r* are provided on the bottom of the lower terminal locking lance 11*g* of the connector housing 10, and a pair of slanting planes 12*r* are provided on the multi-groove 12*f* formed on the basewall 12*b* of the connector housing 10 correspondingly to the pair of tapered planes 11*r*.

And, referring to FIG. 4, a groove bottom surface (12*f*) of the multi-groove 12*f* corresponds to an under surface 11*t* of the lower terminal locking lance 11*g* of the connector housing 10.

Another embodiment the present invention will be described hereinafter with reference to FIG. 25–FIG. 31. The same elements or members as those of the previous embodiment has the same reference characters and the related explanation is omitted.

The connector housings 10',10" shown in FIG. 25–FIG. 31 has the peripheral walls 12',12" each including the basewall 12*b*' and is provided with the connector accommodating portion 17' from the front opening 12*d*' to the holder body accommodating portion 16'. And, as shown in FIG. 25, FIG. 27, FIG. 28, and FIG. 31, an opening portion 12*f*" continuing from the relief groove 12*f*' is provided in the vicinity of the bottom of each of the sidewalls 12*c*',12*c*" of the connector housings 10',10".

As shown in FIG. 25–FIG. 31, the relief groove 12*f*' is provided for the lower locking lance 11*g* of each of the connector housings 10',10", which relief groove 12*f*' laterally extends from the opening portion 12*f*" of each of the sidewalls 12*c*',12*c*" of the connector housings 10',10" to the other respective sidewalls 12*c*.

The relief groove 12*f*' secures the bending amount of the locking lance 11*g*.

And, as shown in FIG. 31, a side spacer 30' to secondarily-lock the terminal is provided on the connector housing 10". The spacer 30' has a pair of partition walls 31*c*', an operating portion 32' connecting the partition walls 31*c*', and an terminal accommodating portion 31*a*' surrounded by the partition walls 31*c*' and the operating portion 32'.

And, a spacer accommodating portion 13' is laterally provided in the connector housing 10", and an insertion opening 13" is formed on one sidewall 12*c*" of the connector housing 10".

The spacer 30' is inserted into the connector housing 10" from the insertion opening 13" and is finally-engaged with the connector housing 10". The terminal in the connector housing 10" is double-locked by both of the terminal locking lance and the partition wall 31*c*' of the spacer 30'.

Figure 11A:
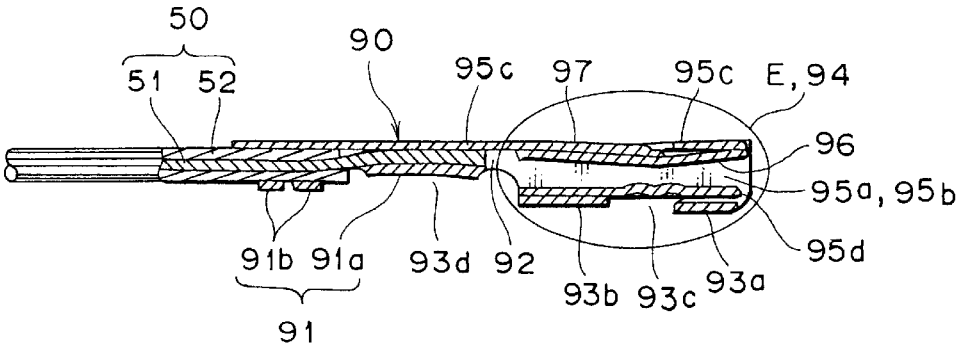
FIG. 11A is a longitudinal sectional view showing an assembly state of a female terminal a wire.

The cable (or wire) 50 shown in FIG. 10, FIG. 11A, FIG. 14–FIG. 16, FIG. 19–FIG. 22, and FIG. 24 has a conductor 51 protected by an insulative cover 52 shown in FIG. 11A.

Next, the connector housing 60 of the connector C2 shown in FIG. 9 and FIG. 19 will be described. According to the downsizing of the above-described connectors C1,C1', the connector housing 60 of the connector C2 is also downsized.

The connector housing 60 has the peripheral wall 62 consisting of the ceiling wall 62*a*, the basewall 62*b* being a bottom wall, a pair of sidewalls 62*c*. And, referring to FIG. 1, FIG. 9, and FIG. 19, the connector housing 60 has a terminal accommodating portion 61*a*, a spacer accommodating portion 63, and a front holder supporting portion 66 (FIG. 19) extending from the bottom wall 62*b*. Further, an engaging lock portion 64 is provided on the ceiling wall 62*a* of the connector housing 60.

And, as shown in FIG. 1, FIG. 9, and FIG. 19, the connector housing 60 is provided with terminal accommodating portions 61*a* being terminal accommodating chambers 61*a* and rear openings 61*b* from which the female terminals 90 (FIG. 19) are inserted in the terminal accommodating chambers 61*a*. The cables 50 (FIG. 19) connected to the female terminals 90 are led out from the rear openings 61*b* of the connector housing 60.

As shown in FIG. 19, the terminal accommodating chamber 61*a* has a horizontal partition wall 61*c* extending from the locking lance 61*g*, vertical partition walls 61*d* positioned ahead of the spacer accommodating portion 63, a rear side horizontal partition wall 61*e* positioned behind the spacer accommodating portion 63, and rear side vertical partition walls 61*f*.

The locking lance 61*g* formed integrally with the connector housing 60 shown in FIG. 19 acts similar to the above locking lances 11*g*, 11*g*'.

The spacer 80 shown in FIG. 19 and FIG. 20 is accommodated in the spacer accommodating portion 63 of the connector housing 60.

As shown in FIG. 1, FIG. 9, and FIG. 19, an engaging lock portion 64 is provided on the ceiling wall 62*a* of the connector housing 60. The engaging lock portion 64 shown in FIG. 1 and FIG. 9 is provided correspondingly to the engaging lock portion 14 of the connector housing 10 shown in FIG. 1 and FIG. 2.

Referring to FIG. 9 and FIG. 19, the engaging lock portion 64 has a pair of guide projections 64*a*, a sides-supported arm 64*d* being a resilient connecting portion 64*e*, a bending space 64*e*' (FIG. 19), a locking projection 64*b* provided on the resilient connecting portion 64*e*, and a pair of steppingly projecting portions 64*h*.

The locking projection 64*b* is provided with an engaging plane 64*c* (FIG. 19), a slant slide plane 64*f*, an initially abutting plane 64*g* (FIG. 19), and a pair of side surfaces. A connection piece 65 (FIG. 9) is provided form one of a pair of guide projections 64*a* to the other thereof.

The pair of steppingly projecting portions 64*h* of the engaging lock portion 64 is provided for easily pushing the sides-supported arm 64*d* on coupling or uncoupling the connectors C1,C2.

And, a pair of guiding projecting portions 69 are provided on the front lower portion of the connector housing 60 as shown in FIG. 9 and FIG. 19 correspondingly to a pair of guiding grooves 19 provided on each of the connector accommodating portions 17,17' of the connector housings 10,10',10" as shown in FIG. 2, FIG. 25, and FIG. 31.

And, referring to FIG. 9, correspondingly to a pair of engaging portions (i.e. projections) 72*d* provided on both sides of the front holder 70, a pair of engaging portions (recesses) 62*d* are provided on the sidewalls 62*c* of the connector housing 60.

The front holder 70 shown in FIG. 1, FIG. 9, and FIG. 19 will be described. As shown in FIG. 19 and FIG. 20, the front holder 70 is not used for double-locking the terminal. As shown in FIG. 19, the front holder 70 has a ceiling wall 72*a*, a bottom wall 72*b*, a front wall 72*c*, sidewalls, and a horizontal partition wall 71*c*, in which an accommodating portion of the front portion of the female terminal 90 is formed. The horizontal partition wall 71*c* extends between the sidewalls.

A plurality of terminal insertion openings 71*b* each having tapered guide plane 71*a* and a plurality of jig passing-through portions (not shown) are provided on the front holder 70. Referring to FIG. 19–FIG. 24, the electrical contact portion 44 of the male terminal 40 is led into the terminal accommodating chamber 95*a* provided on the electrical contact portion 94 of the female terminal 90 shown in FIG. 23 through the terminal insertion opening 71*b*.

The jig passing-through portions are provided similarly to the jig passing-through portions 23 shown in FIG. 7 and FIG. 16.

Referring to FIG. 9, a pair of engaging projections 72*d* are provided on the respective lateral end portions of the front holder 70. The pair of engaging projections 72*d* engage the respective engaging recesses 62*d* provided on the sidewalls 62*c* of the connector housing 60. Like this, the front holder 70 is attached to the connector housing 60.

The spacer 80 shown in FIG. 19 will be described. The spacer 80 has terminal accommodating portions 81*a*, an operating portion 82, an operation projection 83 continuing from the operating portion 82, and a pair of engaging projecting pieces (not shown) provided on the respective right and left portions of the spacer 80.

Similarly to the spacer 30 shown in FIG. 8 and FIG. 16, the operating portion 82 of the spacer 80 shown in FIG. 19 has a baseplate and support plates upstanding on the baseplate. And, the operation projection 83 continuing from the operating portion 82 provided on the spacer 80 is accommodated in the bottom wall 62*b* of the connector housing 60.

The pair of engaging projecting pieces provided on the spacer 80 is formed similarly to the engaging projecting piece 33 of the spacer 30 shown in FIG. 8. A provisionally engaging portion (not shown) and a finally engaging portion (not shown) are provided on the pair of engaging projecting pieces, and a provisionally engaging portion (not shown) and a finally engaging portion (not shown) for the above engaging portions are provided inside the connector housing 60.

As shown in FIG. 19, the terminal accommodating portion 81*a* of the spacer 80 has upper and lower slanting partition walls 81*c* and vertical partition walls 81*d*. The female terminal 90 is put through the terminal accommodating portion 81*a* of the spacer 80.

The spacer 80 is accommodated in the spacer accommodating portion 63 of the connector housing 60 of the connector C2. When the spacer 80 is inserted in the spacer accommodating portion 63, the spacer 80 is not completely inserted in the spacer accommodating portion 63 but is inserted in it in a primary engagement state. Subsequently, the female terminal 90 to which the cable 50 is crimped is inserted in the connector housing 60 and the spacer 80.

And, as shown in FIG. 19 and FIG. 20, the female terminal 90 inserted in the connector housing 60 is primarily-locked by the locking lance 61*g* integrally molded with the connector housing 60, and the spacer 80 is secondarily-locked in the spacer accommodating portion 63 in the connector housing 60. And, the female terminal 90 is secondarily-locked by the slanting partition wall 81*c* inside the connector C2 by completely inserting the spacer 80 in the connector housing 60. Like this, the female terminal 90 is securely double-locked by the connector C2.

A side spacer 30' shown in FIG. 31 may be used in place of the spacers 30 and 80 shown in FIG. 14–FIG. 16, FIG. 19, FIG. 20, FIG. 29 and FIG. 30. The side spacer 30' is laterally inserted from the sidewall 12*c*" of the peripheral wall 12" forming the connector housing 10".

The above connector housings 10,10',10",60, the front holders 20,70, and the spacers 30,30', 80 are, for example, made of injection-moldable thermoplastic synthetic resin.

And, referring to FIG. 17 and FIG. 18, the resilience is required for the provisionally engaging portion 15*e* and the finally engaging portion 15*f* of the arm accommodating chamber 15*a* of the connector housing 10 and for the provisionally engaging portion 25*e* and the finally engaging portion 25*f* of the cantilever arm 25 of the front holder 20. Therefore, the connector housing 10 and the front holder 20 are made of synthetic resin with resilience.

And, referring to FIG. 8, the spacer 30 with a pair of engaging projecting pieces 33 each having the provisionally engaging portion 34 and the finally engaging portion 35 is made of synthetic resin with resilience.

Correspondingly to the provisionally engaging portion 34 the finally engaging portion 35, the provisionally engaging portion and the finally engaging portion are provided on the connector housing 10. The resilience is required for the provisionally engaging portion and the finally engaging portion of the connector housing 10. Therefore, the connector housing 10 is made of synthetic resin having the resilience.

Figure 11B:
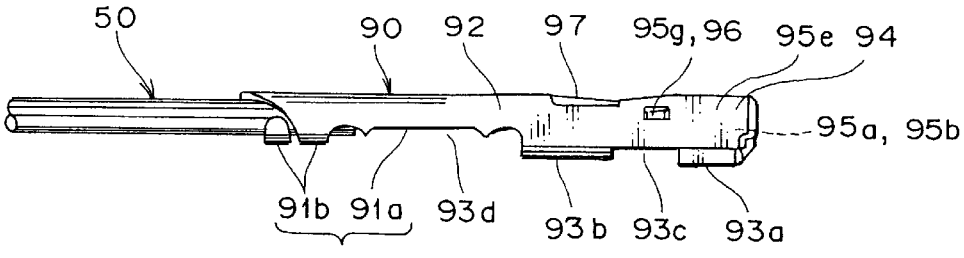
FIG. 11B is a side view showing an assembly state of a female terminal a wire.

Next, the female terminal 90 shown in FIG. 11A and FIG. 11B is described. The female terminal 90 has a box shape corresponding to the male terminal 40 and has an elastic contact piece 96 (FIG. 11A, FIG. 12) inside thereof.

And, the female terminal 90 has the wire connecting portion 91, the electrical contact portion 94, the connecting portion 92 connecting the wire connecting portion 91 and the electrical contact portion 94, the provisionally engaging projection 93*a* and the finally engaging projection 93*b*.

Referring to FIG. 11A and FIG. 11B, the electrical contact portion 94 of the female terminal 90 is rectangular-cylindrical and has a terminal accommodating chamber 95*a* inside thereof. The tab 44 of the male terminal 40 shown in FIG. 10 is inserted in the terminal accommodating chamber 95*a* of the electrical contact portion 94 of the female terminal 90 shown in FIG. 11A.

And, referring to FIG. 11, a locking lance accommodating portion 93*c* is provided between the provisionally engaging projection 93*a* and the finally engaging projection 93*b* of the female terminal 90. A partition wall accommodating portion 93*d* is provided between the finally engaging projection 93*b* and the cover crimping piece 91*b*. The female terminal 90 is secondarily-locked in the connector housing 60 (FIG. 19) by placing the slanting partition wall 81*c* of the spacer 80 in the partition wall accommodating portion 93*d* of the female terminal 90.

The electrical contact portion 94 of the female terminal 90 will be described by using FIG. 11A and FIG. 12 in detail. The electrical contact portion 94 of the female terminal 90 has a basewall 95*c*, another wall 95*d* positioned generally in parallel with the basewall 95*c*, and a pair of sidewalls 95*e*. Like this, the female terminal 90 has the terminal accommodating chamber 95*a* and an opening 95*b*. And, an elastic contact piece 96 and a bending support piece 97 are provided on the electrical contact portion 94 of the female terminal 90.

Figure 12:
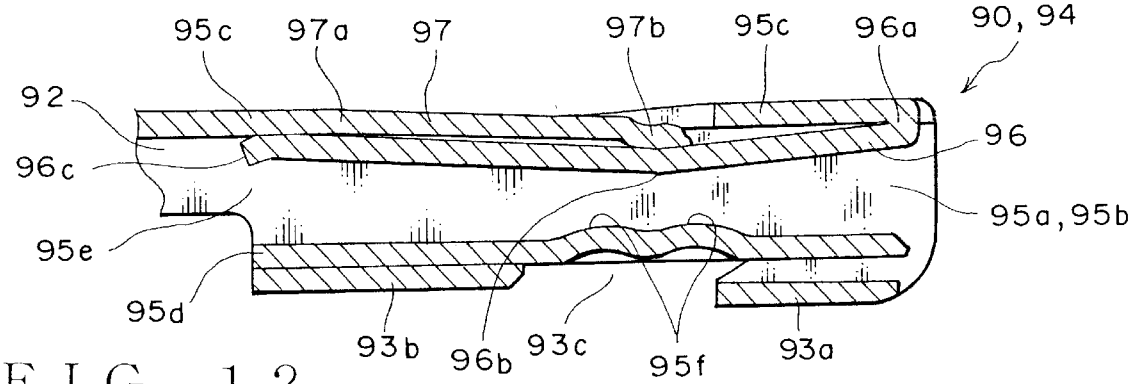
FIG. 12 is an enlarged sectional view of the E-portion of FIG. 11A.

Referring to FIG. 12, the wall 95*d* has a pair of projecting portions 95*f* projecting inwardly. The pair of projecting portions 95*f* are put into contact with the tab 44 (FIG. 10, FIG. 23) of the male terminal 40.

The basewall 95*c* of the electrical contact portion 94 of the female terminal 90 folded inwardly of the terminal accommodating chamber 95*a* at the vicinity of the opening 95*b*, and thereby the elastic contact piece 96 is formed. The elastic contact piece 96 is gradually inclined inwardly of the terminal accommodating chamber 95*a* from a bending portion 96*a*, and a peak portion 96*b* is formed. The elastic contact piece 96 is put into contact with the basewall 95*c* at a free end 96*c* thereof.

A distal end of the free end 96*c* of the elastic contact piece 96 is bent on the basewall 95*c* toward the wall 95*d* so that the free end 96*c* can smoothly slide on the basewall 95*c* without causing a damage of the basewall 95*c*.

A pair of engaging projections (not shown) are provided on the respective right and left sides of the peak portion 96*b* of the elastic contact piece 96 shown in FIG. 12. The pair of engaging projections engage the respective windows 95*g* provided on the sidewalls 95*e* of the female terminal 90 shown in FIG. 11B.

Referring to FIG. 12, a bending support piece 97 is formed on the basewall 95*c*, which bending support piece 97 is inclined inwardly of the terminal accommodating chamber 95*a* from a bent portion 97*a* in the vicinity of the free end 96*c* of the above elastic contact piece 96. The bending support piece 97 extends from the bent portion 97*a* to a spoon-shaped free end 97*b* near the peak portion 96*b* of the above elastic contact piece 96.

The back of the peak portion 96*b* of the elastic contact piece 96 is elastically pressed by the spoon-shaped free end 97*b* of the bending support piece 97 with a smooth sliding and without a damage.

The peak portion 96*b* provided on the elastic contact piece 96 acts as a contact point for the tab 44 (FIG. 10, FIG. 24) of the male terminal 40.

Figure 24:
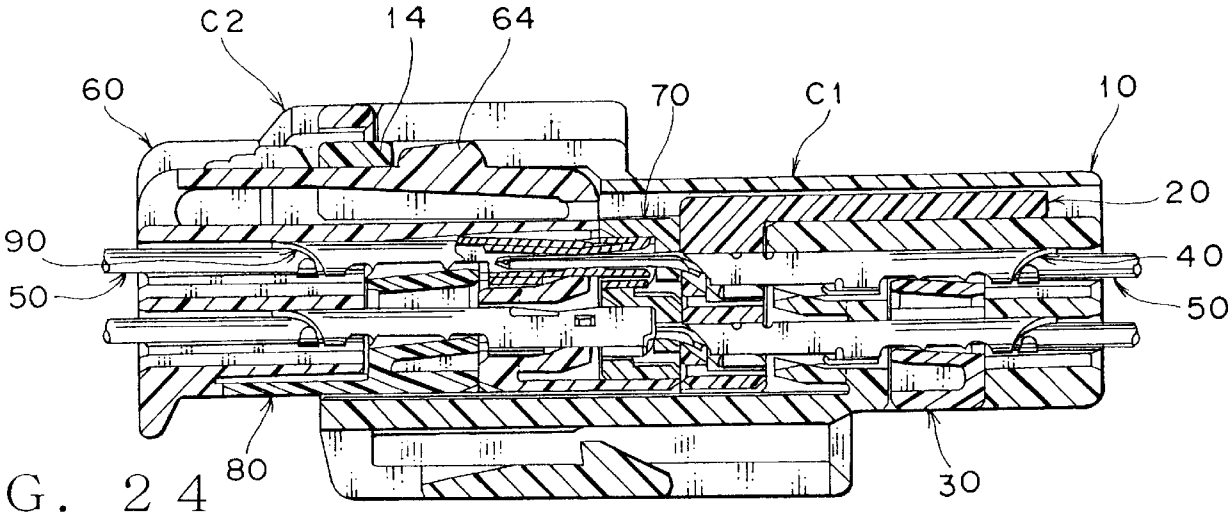
FIG. 24 is a longitudinal sectional view showing a state of the complete coupling of the connectors.

The body 44*b* of the electrical contact portion 44 of the male terminal 40 shown in FIG. 10 is held by the pair of contacts 95*f* provided on the wall 95*d* shown in FIG. 12 and the peak portion 96*b* provided on the elastic contact piece 96, and the male terminal 40 and the female terminal 90 are electrically coupled with each other as shown in FIG. 24.

Figure 22:
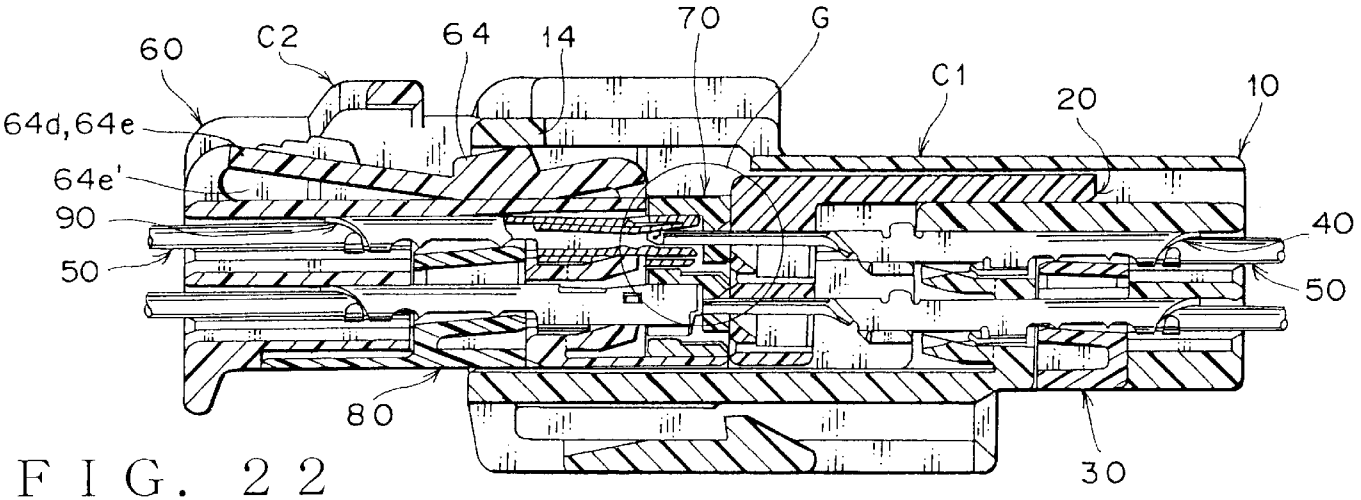
FIG. 22 is a longitudinal sectional view showing a state that the coupling of the connectors are on the way.

The above structure reduces the sliding friction force between the male terminal 40 and the female terminal 90 shown in FIG. 22 FIG. 24, which enables the multipole connector (of 12 poles as shown in FIG. 1, FIG. 4, FIG. 5, FIG. 9, FIG. 13, FIG. 27, and FIG. 28) to be easily coupled with a smaller coupling force.

Referring to FIG. 20–FIG. 24, an embodiment of the holder-equipped connector includes the connector C1 having the connector housing 10 in which the male terminal 40, the front holder 20 to support or protect the electrical contact portion 44 of the male terminal 40, and the spacer 30 to double-lock the male terminal 40 are accommodated, and also includes the connector C2 having the connector housing 60 accommodating the female terminal 90.

Referring to FIG. 20, the coupling of the connectors C1,C2 is started by shifting the connector C2 toward the connector C1 along the coupling direction S4. And, the front face 72*c*' of the connector C2 is pressed (FIG. 22, FIG. 23) on the front face 22*c*' of the front holder 20 accommodated in the connector housing 10 of the connector C1, while the provisional engagement state of the connector housing 10 and the front holder 20 of the connector C1 is changed to the final engagement state.

Referring to FIG. 16–FIG. 18, the front holder 20 retained in the connector housing 10 of the connector C1 in the provisional engagement state is slid in the sliding direction S3 by being pushed and is finally-engaged in the connector housing 10.

And, simultaneously with the final engagement of the front holder 20, the male terminal 40 of the connector C1 is connected (FIG. 24) with the female terminal 90 of the connector C2, and the coupling of the connector C1 and the connector C2 is carried out.

Figure 23:
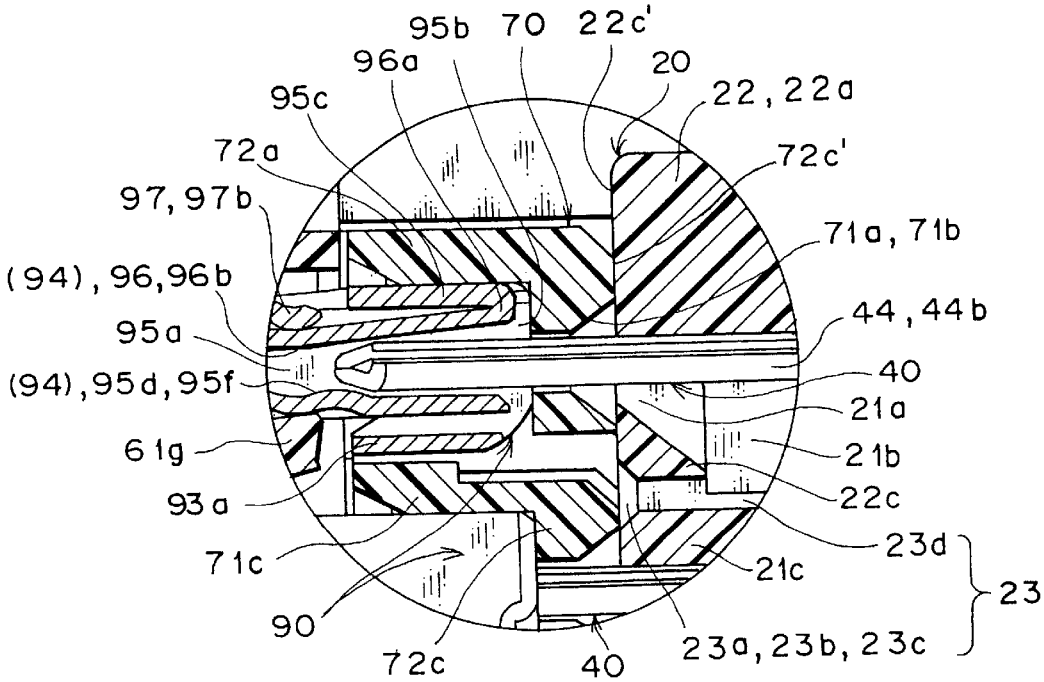
FIG. 23 is an enlarged sectional view of the G-portion of FIG. 22.

As shown in FIG. 23, when the tab 44 of the male terminal 40 comes into contact with the elastic contact piece 96 of the female terminal 90, the front face 72*c*' of the front holder 70 hits on the front face 22*c*' of the front holder 20.

And, as shown in FIG. 1, FIG. 7, FIG. 16–FIG. 18, and FIG. 30, the front holder 20 is longitudinally provided with the resilient cantilever arm 25.

And, the connector housings 10,10' are provided with the arm accommodating portions 15 in the same direction as that of the cantilever arm 25. The arm accommodating portion 15 has the arm accommodating chamber 15*a* having the rear opening 15*b*. The cantilever arm 25 of the front holder 20 is slidable in the arm accommodating portion 15 of each of the connector housings 10,10'.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A holder-equipped connector, comprising:

a terminal;

a connector housing provided with a lance to primarily lock the terminal; and a holder to hold the terminal, wherein a relief portion to secure a bending amount of the lance, being bent when the terminal is attached to the connector housing, is provided on a basewall of the connector housing.

2. The holder-equipped connector as set forth in claim 1, wherein the relief portion is a groove provided from a front opening of the connector housing to a vicinity of a root of the lance linearly in a terminal inserting direction.

3. The holder-equipped connector as set forth in claim 1, wherein a pair of tapered planes are provided on a surface, facing the basewall, of the lance, and a pair of slanting planes are provided on the relief portion formed on the basewall of the connector housing correspondingly to the pair of tapered plane.

4. The holder-equipped connector as set forth in claim 1, wherein the relief portion is a groove provided from one sidewall to the other sidewall of the connector housing in a direction orthogonal to a terminal inserting direction.

5. The holder-equipped connector as set forth in claim 1, further comprising:

a spacer to secondarily lock the terminal to the connector housing, wherein the spacer provisionally engaging the connector housing finally engages the connector housing when the spacer is further deeply inserted from a side of the basewall of the connector housing, and the terminal is double locked by the lance formed integrally with a terminal accommodating chamber of the connector housing and by a slanting partition wall formed on the spacer.

6. The holder-equipped connector as set forth in claim 2, further comprising:

a spacer to secondarily lock the terminal to the connector housing, wherein the spacer provisionally engaging the connector housing finally engages the connector housing when the spacer is further deeply inserted from a side of the basewall of the connector housing, and the terminal is double locked by the lance formed integrally with a terminal accommodating chamber of the connector housing and by a slanting partition wall formed on the spacer.

7. The holder-equipped connector as set forth in claim 3, further comprising:

a spacer to secondarily lock the terminal to the connector housing, wherein the spacer provisionally engaging the connector housing finally engages the connector housing when the spacer is further deeply inserted from a side of the basewall of the connector housing, and the terminal is double locked by the lance formed integrally with a terminal accommodating chamber of the connector housing and by a slanting partition wall formed on the spacer.

8. The holder-equipped connector as set forth in claim 4, further comprising:

a spacer to secondarily lock the terminal to the connector housing, wherein the spacer provisionally engaging the connector housing finally engages the connector housing when the spacer is further deeply inserted from a side of the basewall of the connector housing, and the terminal is double locked by the lance formed integrally with a terminal accommodating chamber of the connector housing and by a slanting partition wall formed on the spacer.

9. The holder-equipped connector as set forth in claim 1, further comprising:

a spacer to secondarily lock the terminal to the connector housing, wherein the spacer finally engages the connector housing when the spacer is inserted from a side of the basewall of the connector housing, and the terminal is double locked by the lance formed integrally with a terminal accommodating chamber of the connector housing and by a partition wall formed on the spacer.

10. The holder-equipped connector as set forth in claim 2, further comprising:

a spacer to secondarily lock the terminal to the connector housing, wherein the spacer finally engages the connector housing when the spacer is inserted from a side of the basewall of the connector housing, and the terminal is double locked by the lance formed integrally with a terminal accommodating chamber of the connector housing and by a partition wall formed on the spacer.

11. The holder-equipped connector as set forth in claim 3, further comprising:

a spacer to secondarily lock the terminal to the connector housing, wherein the spacer finally engages the connector housing when the spacer is inserted from a side of the basewall of the connector housing, and the terminal is double locked by the lance formed integrally with a terminal accommodating chamber of the connector housing and by a partition wall formed on the spacer.

12. The holder-equipped connector as set forth in claim 4, further comprising:

a spacer to secondarily lock the terminal to the connector housing, wherein the spacer finally engages the connector housing when the spacer is inserted from a side of the basewall of the connector housing, and the terminal is double locked by the lance formed integrally with a terminal accommodating chamber of the connector housing and by a partition wall formed on the spacer.

* * * * *